US008668325B2

(12) United States Patent
Usuda et al.

(10) Patent No.: US 8,668,325 B2
(45) **Date of Patent: *Mar. 11, 2014**

(54) CONTROL METHOD OF LIQUID EJECTING APPARATUS

(75) Inventors: Hidenori Usuda, Matsumoto (JP); Seiya Sato, Matsumoto (JP); Shinichi Kamoshida, Shiojiri (JP); Koichiro Miyazaki, Ina (JP)

(73) Assignee: Seiko Epson Corporation, Tokyo (JP)

( * ) Notice: Subject to any disclaimer, the term of this patent is extended or adjusted under 35 U.S.C. 154(b) by 199 days.

This patent is subject to a terminal disclaimer.

(21) Appl. No.: 13/246,760

(22) Filed: Sep. 27, 2011

(65) Prior Publication Data

US 2012/0081446 A1 Apr. 5, 2012

(30) Foreign Application Priority Data

Sep. 30, 2010 (JP) ..... 2010-220811

(51) Int. Cl.
*B41J 2/01* (2006.01)
*B41J 29/38* (2006.01)
*B41J 2/165* (2006.01)

(52) U.S. Cl.
USPC ..... 347/102; 347/16; 347/35

(58) Field of Classification Search
None
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 8,033,660 | B2 * | 10/2011 | Nakazawa et al. | 347/102 |
| 2006/0158481 | A1 * | 7/2006 | Spevak et al. | 347/43 |
| 2007/0188547 | A1 | 8/2007 | Kobayashi et al. | |
| 2009/0295857 | A1 | 12/2009 | Kikuchi et al. | |
| 2010/0302299 | A1 | 12/2010 | Kobayashi et al. | |

FOREIGN PATENT DOCUMENTS

| | | |
|---|---|---|
| CN | 1915676 | 2/2007 |
| EP | 0790128 | 8/1997 |
| JP | 2007160793 | 6/2007 |

* cited by examiner

*Primary Examiner* — Geoffrey Mruk
(74) *Attorney, Agent, or Firm* — Workman Nydegger

(57) ABSTRACT

A liquid ejecting apparatus includes first liquid ejecting nozzles that eject first liquid; a second liquid ejecting nozzle that ejects second liquid which is different from the first liquid; and a control unit which performs control of ejection of the first liquid from the first liquid ejecting nozzles and ejection of the second liquid from the second liquid ejecting nozzles. The control unit has a first mode of performing control to form flushing dots by ejection from the first liquid ejecting nozzles on a recording medium, the ejection not being based on image data, form background dots by ejection from the second liquid ejecting nozzle on the flushing dots, the ejection being based on the image data, and form image dots by ejection from the first liquid ejecting nozzles on the background dots, the ejection being based on the image data.

12 Claims, 19 Drawing Sheets

FRONT PRINTING MODE (FIRST MODE)

REAR PRINTING MODE (SECOND MODE)

FRONT PRINTING MODE (FIRST MODE)

REAR PRINTING MODE (SECOND MODE)

CONTROL METHOD OF LIQUID EJECTING APPARATUS

This application claims the benefit of Japanese Patent Application No. 2010-220811, filed on Sep. 30, 2010, which is hereby incorporated by reference herein in its entirety.

BACKGROUND

1. Technical Field

The present invention relates to a control method of a liquid ejecting apparatus used in an ink jet type printer or the like.

2. Related Art

An ink jet type printer (hereinafter, simply referred to as a "printer") has been used which ejects ink (liquid) onto a recording medium (target) using a liquid ejecting apparatus that ejects liquid onto a target from a recording head as a liquid ejecting head. In such a printer, when a state in which ink is not ejected from nozzles of the recording head is continued for a long time, there is a concern of the surface of an ink meniscus in the nozzle drying, resulting in an ink ejection defect. Therefore, in such a printer, so-called flushing in which ink is forcibly ejected from the nozzles on the basis of a control signal unrelated to printing is performed (for example, refer to JP-A-2007-160793).

For example, in a case of a serial type or lateral type printer in which a recording head ejects ink while reciprocating along a transport plane of a recording sheet during printing, the recording head is moved to a non-printing region deviating from the recording sheet, and flushing is performed so that ink is flushed into a liquid storage unit such as a cap or a flushing box disposed in the region. On the other hand, in a case of a line head type printer in which a recording head is disposed over the entire sheet width in the direction perpendicular to a transport direction of a recording sheet on a transport path of the recording sheet without moving along the transport plane of the recording sheet, a liquid storage unit such as a cap is movable and flushing is performed by moving the liquid storage unit to a position that is close to and opposes a nozzle formation surface of the recording head.

In addition, after ending the flushing, the liquid storage unit such as a cap and the recording head are moved relative to each other in separate directions. That is, in the case of the serial type or lateral type printer, the recording head is moved from the position that is close to and opposes the liquid storage unit such as a cap in a direction to be separated. On the other hand, in the case of the line head type printer, the liquid storage unit such as a cap is moved from the position that is close to and opposes the recording head in a direction to be separated. In addition, when the nozzle formation surface of the recording head is in a state of opposing the recording sheet due to the relative movement, ink for printing is ejected again from the nozzles of the recording head toward the recording sheet.

In the case of the serial type or lateral type printer as such, the liquid storage unit such as a flushing box is provided in the non-printing region deviating from the recording sheet and flushing is performed therein. Therefore, there are problems in that a margin space is needed for an apparatus housing of the printer, and time loss occurs for the taken time corresponding to the movement of the recording head, resulting in a reduction in throughput.

These problems also occur in the case of the line head type printer, and even in the case of the line head type printer, the movable liquid storage unit such as a cap is provided and flushing is performed by moving the liquid storage unit to a position that is close to and opposes the nozzle formation surface of the recording head. Therefore, similarly, there are problems in that a margin space is needed for the apparatus housing of the printer, and time loss occurs for the time taken corresponding to the movement of the recording head, resulting in a reduction in throughput.

SUMMARY

According to an aspect of the invention, there is provided a control method of a liquid ejecting apparatus which includes a first liquid ejecting nozzle which ejects UV-curable first liquid, a second liquid ejecting nozzle which ejects UV-curable second liquid which is different from the first liquid, a UV illumination light source which illuminates the first liquid and the second liquid, and a control unit which performs control of ejection of the first liquid from the first liquid ejecting nozzle, ejection of the second liquid from the second liquid ejecting nozzle, and UV illumination of the ejected first liquid and the second liquid, the control method causing the control unit to perform control so as to sequentially perform: forming flushing dots using UV-curable ink by ejection from the first liquid ejecting nozzle on a recording medium, the ejection being not based on image data; illuminating the flushing dots with UV light; forming background dots using UV-curable ink by ejection from the second liquid ejecting nozzle on the flushing dots, the ejection being based on the image data; illuminating the background dots with UV light; forming image dots using UV-curable ink by ejection from the first liquid ejecting nozzle on the background dots, the ejection being based on the image data; and illuminating the image dots with UV light, wherein illumination energy of the UV light illuminating the flushing dots in the illuminating of the flushing dots is lower than illumination energy of the UV light illuminating the background dots in the illuminating of the background dots.

In addition, when the UV illumination light source is a metal-halide lamp, an application voltage of the illuminating of the flushing dots may be lower than an application voltage of the illuminating of the background dots.

In addition, when the UV illumination light source is a UV-LED, an application current of the illuminating of the flushing dots may be lower than an application current of the illuminating of the background dots.

In addition, when the UV illumination light source is a UV-LED having a plurality of light-emitting sources, the number of light sources which are lit up in the illuminating of the flushing dots may be smaller than the number of light sources which are lit up in the illuminating of the background dots.

According to another aspect of the invention, there is provided a liquid ejecting apparatus which can produce a printed matter according to the control method of a liquid ejecting apparatus according to any of the descriptions.

According to still another aspect of the invention, there is provided a printed matter which is produced according to the control method of a liquid ejecting apparatus according to any of the descriptions.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
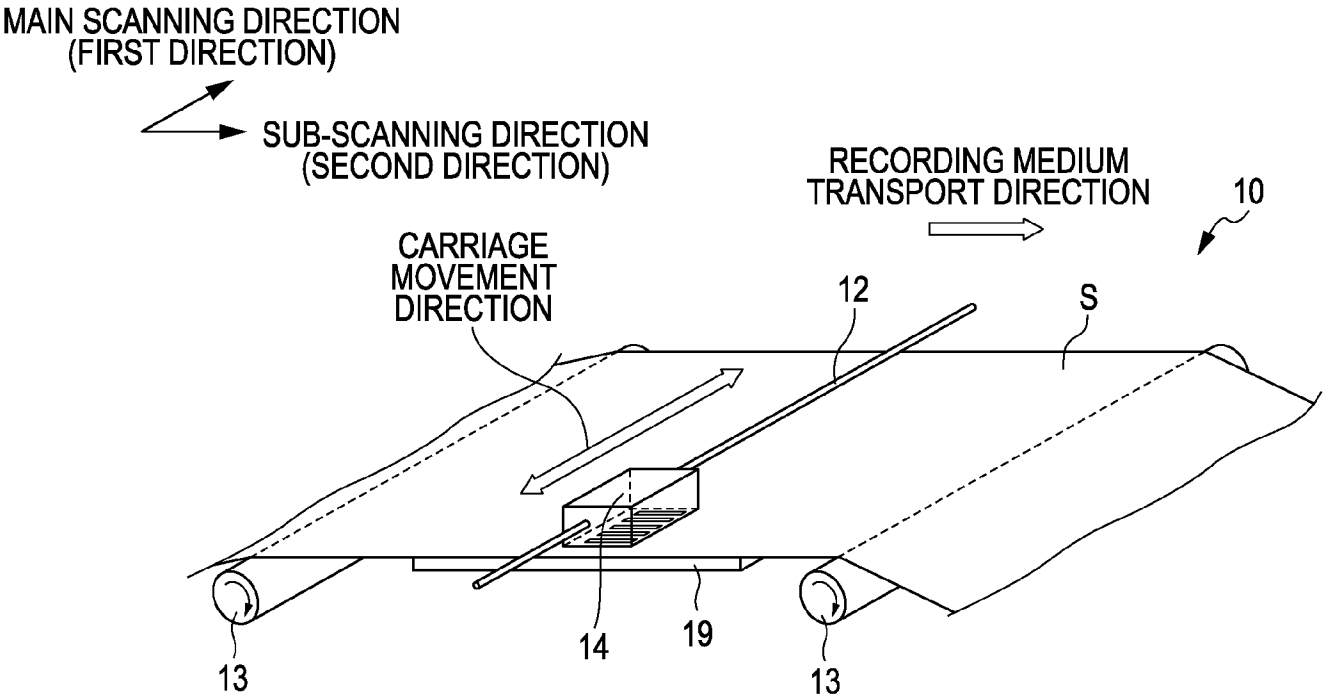
FIG. 1 is a diagram showing the overview of a printer which uses a liquid ejecting apparatus according to an embodiment of the invention.
Figure 2:
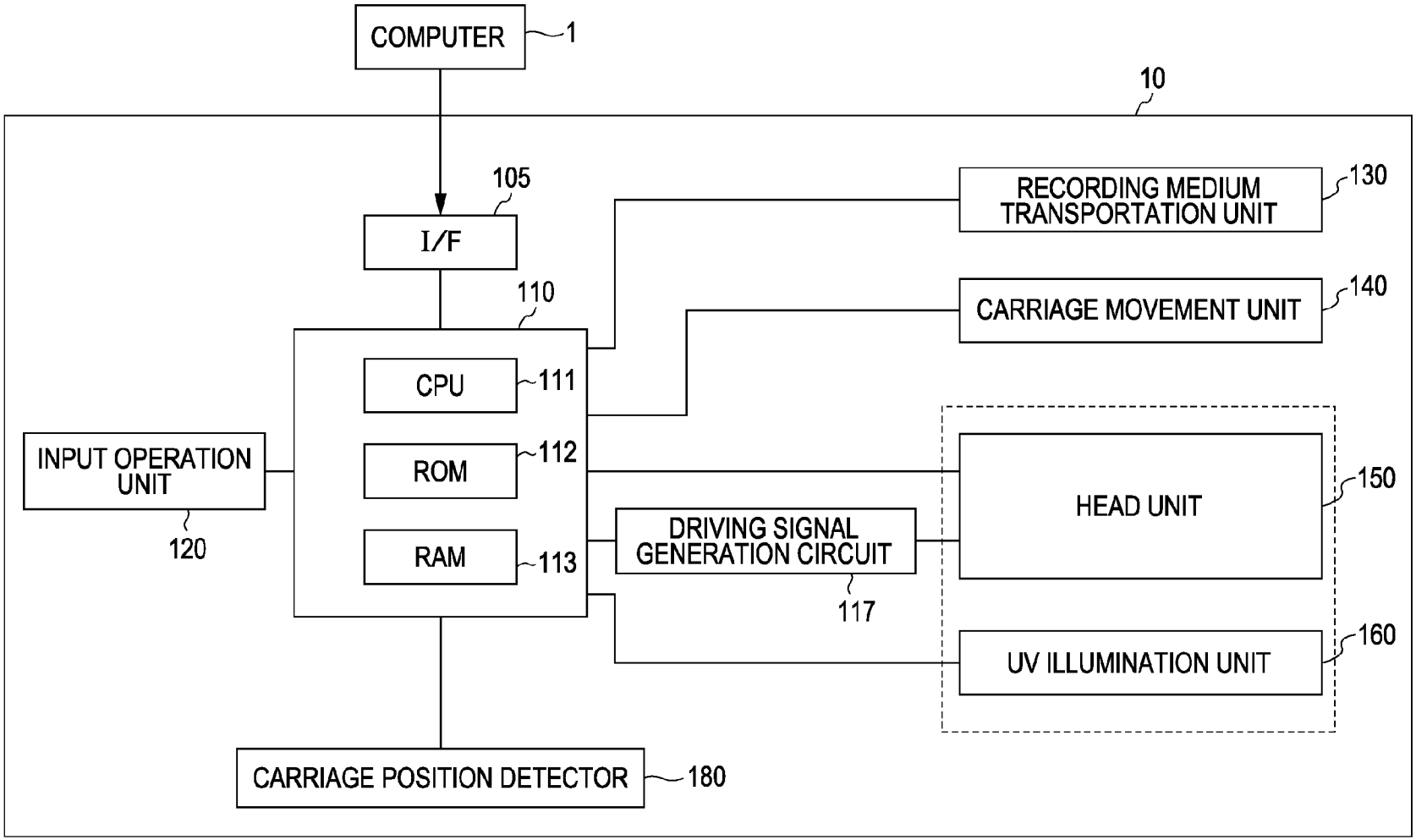
FIG. 2 is a block diagram of the entire configuration of the printer.
Figure 3:
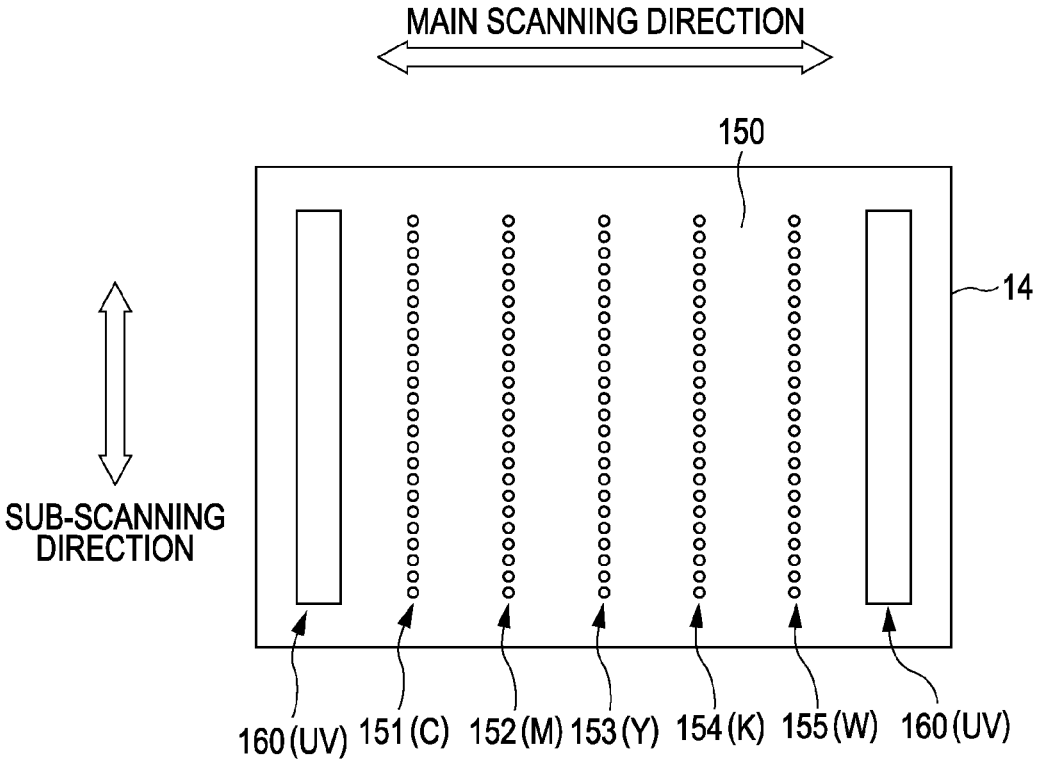
FIG. 3 is a diagram illustrating a head unit and a UV illumination unit mounted in a carriage of the printer.

Hereinafter, an embodiment of the invention will be described with reference to the drawings. FIG. 1 is a diagram showing the overview of a printer 10 which uses a liquid ejecting apparatus according to an embodiment of the invention, and shows an ink jet recording apparatus of a serial head type. FIG. 2 is a block diagram of the entire configuration of the printer 10. FIG. 3 is a diagram illustrating a head unit 150 and a UV illumination unit 160 mounted in a carriage 14 of the printer 10.

As shown in FIG. 1, the printer 10 has a bar-shaped guide rail 12, and a carriage 14 is supported by the guide rail 12. The carriage 14 is reciprocated along the guide rail 12 in a main scanning direction (first direction) by a carriage driving unit 140 (see FIG. 2).

At the center portion of the carriage 14, the head unit 150 is mounted which has nozzles (first liquid ejecting nozzles and second liquid ejecting nozzles described later) formed to discharge color ink for each of yellow (Y), magenta (M), cyan (C), black (K), and white (W) onto a recording medium S.

The color ink for yellow (Y), magenta (M), cyan (C), and black (K) from the color ink discharged from the head unit 150 is ink mainly for image recording and is used to draw a predetermined image based on image data received from a computer 1 or the like which is a higher-level device.

On the other hand, the white (W) ink from the ink discharged from the head unit 150 is used to entirely paint in white the background of the predetermined image recorded by the ink for image recording, on the basis of background image data received from the computer 1 or the like which is a higher-level device.

In addition, the color ink for yellow (Y), magenta (M), cyan (C), and black (K) each of which is the ink for image recording is defined as the "first liquid", and the white (W) ink which is the ink for printing the entire background is defined as the "second liquid". In the following description, there may be cases where yellow or yellow ink is abbreviated to "Y" or the like.

The computer 1 sends image data according to an image to be printed to the printer 10 via a printer driver. The image data includes pixel data indicating whether or not ink for each ink color is to be discharged onto each pixel of the recording medium S.

In addition, the ink used in this embodiment is UV-curable UV ink which is cured by being illuminated with UV. As the UV-curable ink, radical polymerization-based ink containing a radical polymerizable compound as a polymerizable compound, cation polymerization-based ink containing a cation polymerizable compound, a hybrid type ink having a combination of the radical polymerization-based ink and the cation polymerization-based ink may be applied. In addition, as the ink, a polymerizable compound which is polymerized and cured by light other than UV light, and a photoinitiator which initiates a polymerization reaction of polymerizable compounds with light other than UV, for example, electron beams, X-rays, infrared light, and the like may also be applied.

As the recording medium S used in the printer 10 according to the embodiment of the invention, a recording medium S made of a material such as various kinds of paper such as plain paper, recycled paper, or glossy paper, various kinds of fabric, various kinds of nonwoven fabric, resin, metal, or glass may be applied. In this embodiment, a transparent or translucent non-absorbable resin film which is used for so-called soft packaging is used as appropriate.

In a case where the resin film as the recording medium S is a transparent or translucent medium, back printing as well as front printing is possible. In addition, as the resin of the resin film, PET (polyethylene terephthalate), PS (polystyrene), PP (polypropylene), or the like is used as appropriate.

Here, for example, in a case where printing is performed on a transparent resin film, in order to maintain durability against abrasion of printing surfaces, printing may be performed on the back side of the resin film, which is called "back printing". A printed image by the "back printing" is seen through the resin film. In addition, it is needless to say that in a case where printing is performed on an opaque resin film, printing is performed on the front side of the resin film, which is called "front printing". Of course, the "front printing" can be applied to the resin film which is the transparent or translucent medium.

There may be cases where, on a transparent resin film, an image such as characters, symbols, or pictures is printed by overlapping colors of the ink for image recording using characteristics of white (W) ink or the like as a background color. When back printing is performed using such printing, ink with each of the colors is printed first, and thereafter, for example, white ink may be printed. When front printing is performed, white ink is printed first, and thereafter, ink with each of the colors may be printed.

The head unit 150 as described above is connected to a controller 110 and a driving signal generation circuit 117, and to the head unit 150, a driving signal COM, a signal for controlling ink discharge, and the like are sent.

In both side portions of the head unit 150 in the carriage 14, the UV illumination units 160 as UV illumination light sources that illuminate, with UV light, ink discharged from the first liquid ejecting nozzles for ejecting the first liquid and the second liquid ejecting nozzles for ejecting the second liquid to the recording medium S are respectively provided from the upstream side end portion to the downstream side end portion of a sub-scanning direction (second direction) which is perpendicular to the main scanning direction (first direction) of the head and in which the recording medium S is transported.

The center portion of a movable range of the carriage 14 becomes a recording region where recording is performed on the recording medium S, and in the recording region, a platen 19 which horizontally supports the recording medium S from a non-recording surface side is provided.

In the printer 10, a recording medium transport unit 130 (see FIG. 2) which is configured of a plurality of transport rollers 13 and the like for sending the recording medium S in the sub-scanning direction (second direction) is provided. The recording medium transport unit 130 intermittently transports the recording medium S by repeating transport and stop of the recording medium S in response to the operation of the carriage 14 during image recording.

In the upper surface of the housing (not shown) of the printer 10, an input operation unit 120 is provided which is configured of, for example, a touch panel to display recording modes that can be selected by a user and by which the user selects and inputs the displayed recording modes. The input operation unit 120 is connected to the controller 110 described later and outputs a signal associated with the recording mode selected on the basis of a predetermined operation to the controller 110.

FIG. 2 shows control blocks for controlling the printer 10 in this embodiment. The controller 110 in the control blocks includes, for example, a CPU 111, a ROM 112, and a RAM 113, develops processing programs recorded in the ROM 112 on the RAM 113, and executes the processing programs using the CPU 111. An interface (I/F) 105 is an interface provided to connect the controller 110 of the printer 10 to the computer 1.

The controller 110 as a control unit controls operations of each of the members on the basis of statuses such as operation statuses of the recording medium transport unit 130, the carriage driving unit 140, the head unit 150, the UV illumination units 160, and the like. A carriage position detector 180 is configured of a position detection sensor (not shown) or the like which detects an origin position of the carriage 14 and detection information obtained here is input to the controller 110 for proper use in a driving process of the carriage driving unit 140.

The driving signal generation circuit 117 generates a driving signal COM described later. The driving signal generation circuit 117 acquires data regarding the waveform of the driving signal COM from the controller 110. In addition, the driving signal COM is generated by generating a voltage signal on the basis of data regarding the waveform and subjecting this to current amplification. An example of the waveform of the driving signal COM will be described later.

The UV illumination unit 160 is a device for curing UV ink by illuminating UV ink discharged onto the recording medium S with UV light. The UV illumination light source of the UV illumination unit 160 is configured of, for example, a UV-LED (Ultra Violet Light Emitting Diode) which generates UV light, or the like. In addition, the illumination rate of the UV light can be controlled under the control of the controller 110 as the control unit.

In this manner, an amount of UV light illuminating each position of the recording medium S can be changed. In addition, as the UV illumination light source, a metal-halide lamp, a xenon lamp, a carbon-arc lamp, a chemical lamp, a low-pressure mercury lamp, a high-pressure mercury lamp, or the like can be used.

In the printer 10, the controller 110 controls the head unit 150, the recording medium transport unit 130, and the like so as to discharge ink and record an image by changing the order of ink discharge from the head unit 150 according to the recording mode such as a front printing mode or a back printing mode.

In this embodiment, the printer 10 mainly has two recording modes as the recording modes.

First, on the surface of the recording medium S, a process of forming flushing dots by ejection from the first liquid ejecting nozzles, the ejection not being based on image data is performed, and thereafter a first UV illumination process of illuminating the flushing dots with UV light is performed.

Thereafter, a process of forming background dots on the flushing dots by ejection of white ink (second liquid) from the second liquid ejecting nozzles, the ejection being based on the image data, is performed, and a second UV illumination process of illuminating the background dots with UV light is performed.

A process of forming image dots by ejection of the ink for image recording (first liquid) on the background dot, the ejection being based on the image data, is performed thereon, and a third UV illumination process of illuminating the image dots with UV light is performed, thereby realizing the front printing mode (first mode) in which an image is recorded.

Moreover, there is the back printing mode (second mode) in which the processes are performed on the back surface of the recording medium S in the reverse order to that of the front printing mode.

Next, the head unit 150 mounted in the carriage 14 of the printer 10 will be described with reference to FIG. 3. FIG. 3 schematically shows the bottom surface (a surface that opposes the recording medium S) of the carriage 14. As shown in FIG. 3, the head unit 150 includes nozzle rows 151 to 155 each in which a plurality of nozzles is lined up in the sub-scanning direction. In this embodiment, each nozzle row is formed of 180 nozzles. The number of nozzles in the nozzle row is abbreviated in the figure. The nozzle rows 151 to 155 correspond to ink colors of the ink discharged from the head unit 150.

That is, the nozzle rows 151 to 154 in which the first liquid ejecting nozzles are formed are configured of a nozzle row 151 for cyan ink discharge, a nozzle row 152 for magenta ink discharge, a nozzle row 153 for yellow ink discharge, and a nozzle row 154 for black ink discharge. The nozzle row 155 in which the second liquid ejecting nozzles are formed is configured of a nozzle row 155 for white ink discharge.

In addition, in this embodiment, in the nozzle row corresponding to each color ink, the nozzles are lined up in a single row. However, the arrangement of the nozzles of the single nozzle row is not particularly limited, and for example, the nozzles may be lined up in a plurality of rows or the nozzles in a plurality of rows may be arranged in a zigzag pattern.

In addition, the head unit 150 shown in FIG. 3 has a configuration in which all the nozzle rows 151 to 155 are provided in a single head structural member. However, a configuration in which the nozzles of each of the nozzle rows 151 to 155 are provided in a different head structural member and the head structural members are mounted in the carriage 14 may also be employed. When the different head structural members are configured, a single head structural member may be configured to correspond to a single nozzle row, or a single head structural member may be configured to correspond to a plurality of nozzle rows.

Figure 4:
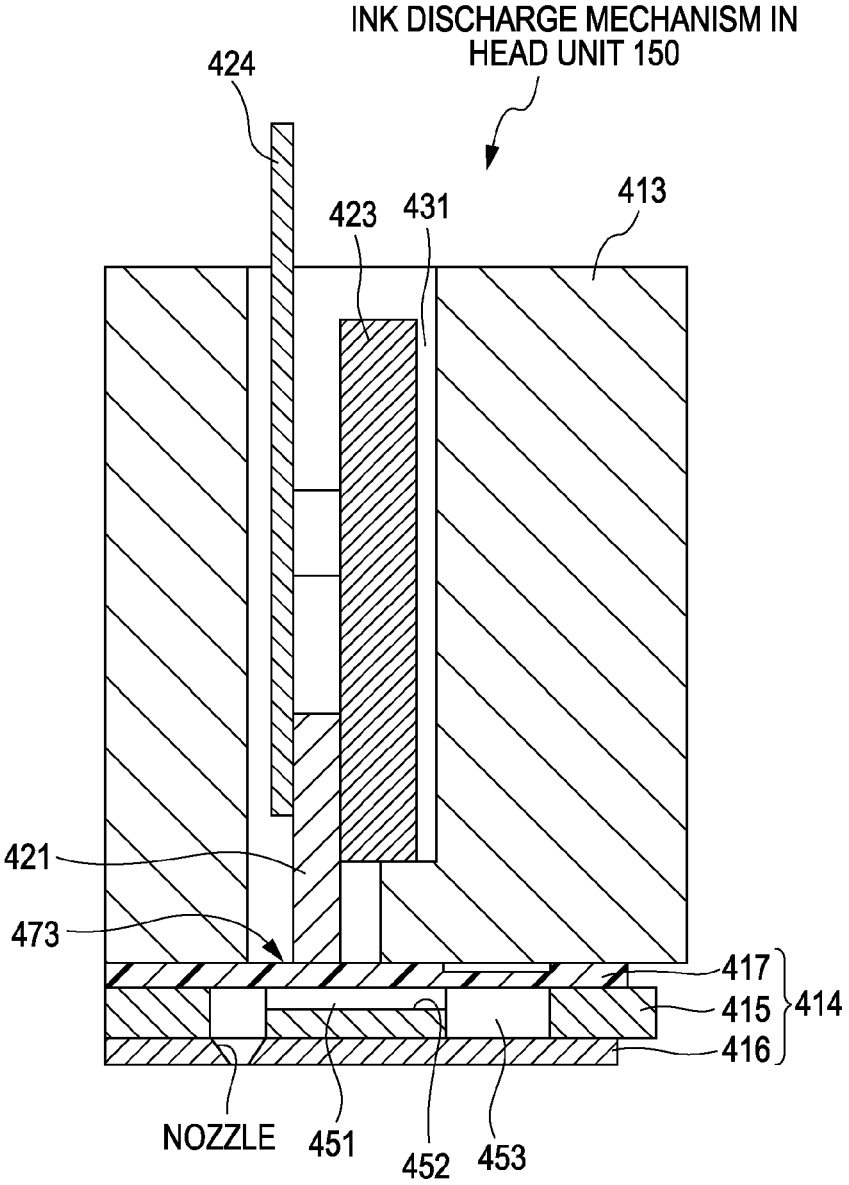
FIG. 4 is a cross-sectional view illustrating an ink discharge mechanism in the head unit.

FIG. 4 is a cross-sectional view illustrating an ink discharge mechanism in the head unit 150. Here, with reference to FIG. 4, the structure of a driving unit for discharging ink from the individual nozzles in the head unit 150 will be described.

The driving unit includes a plurality of piezoelectric elements 421, a fixed plate 423 to which the piezoelectric element group 421 is fixed, and a flexible cable 424 for supplying power to each of the piezoelectric elements 421. Each of the piezoelectric elements 421 is mounted to the fixed plate 423 in a so-called cantilevered state. The fixed plate 423 is a plate-shaped member having such rigidity to receive a reaction force from the piezoelectric element 421. The flexible cable 424 is a sheet-shaped wiring substrate having flexibility and is electrically connected to the piezoelectric element 421 at a side surface of a fixed end portion on the opposite side to the fixed plate 423. On the surface of the flexible cable 424, a head control unit (not shown) which is a control IC for controlling driving of the piezoelectric element 421 and the like is mounted. The head control unit is provided for each nozzle group of the head.

A flow passage unit 414 includes a flow passage formation substrate 415, a nozzle plate 416, and an elastic plate 417 which are laminated to be configured in one body so that the flow passage formation substrate 415 is interposed between the nozzle plate 416 and the elastic plate 417. The nozzle plate 416 is a thin plate of a stainless steel product with nozzles formed.

In the flow passage formation substrate 415, a plurality of cavity portions which become pressure chambers 451 and ink supply openings 452 is formed to correspond to each nozzle. A reservoir 453 is a liquid storage chamber for supplying ink stored in an ink cartridge to each of the pressure chambers 451 and communicates with the other end of the corresponding pressure chamber 451 through the ink supply opening 452. In addition, the ink from the ink cartridge passes through an ink supply tube (not shown) and is introduced into the reservoir 453. The elastic plate 417 includes an island portion 473. In addition, the front end of a free end portion of the piezoelectric element 421 is bonded to the island portion 473.

When a driving signal is supplied to the piezoelectric element 421 via the flexible cable 424, the piezoelectric element 421 extends or contracts so as to expand or contract the volume of the pressure chamber 451. Due to the change in the volume of the pressure chamber 451, a change in the pressure of the ink in the pressure chamber 451 occurs. In addition, using the change in the pressure of the ink, the ink can be discharged from the nozzles.

This embodiment is described on the basis of the configuration in which ink is discharged using the piezoelectric element 421, however, a method of discharging liquid from the nozzles is not limited thereto. For example, other methods such as a method of generating bubbles in the nozzles by heat may also be used.

Figure 5:
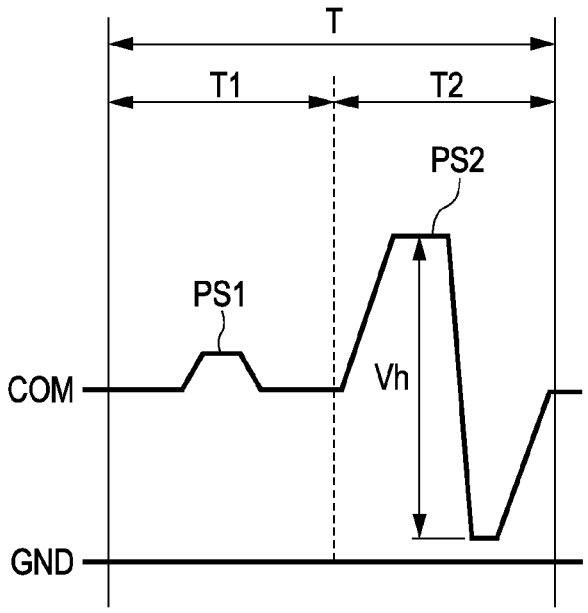
FIG. 5 is a diagram illustrating an example of a driving signal generated by a driving signal generation circuit.

FIG. 5 is a diagram illustrating an example of the driving signal COM generated by the driving signal generation circuit 117. As shown in FIG. 5, the driving signal COM is repeatedly generated for every repetition period T.

A period T which is a repetition period corresponds to a period for which the ink discharge nozzle in the carriage 14 is moved relative to the recording medium S by one pixel in the main scanning direction (first direction). For example, in a case where a printing resolution of the main-scanning direction (first direction) is 360 dpi, the period T corresponds to a period for moving the carriage 14 by 1/360 inches with respect to the recording medium S. In addition, by applying driving pulses PS1 and PS2 of each section included in the period T to the piezoelectric element 421 on the basis of pixel data included in printing data, dots can be formed in a single pixel.

The driving signal COM has the driving pulse PS1 generated in a section T1 in the repetition period and the driving pulse PS2 generated in a section T2.

The driving pulse PS1 is a micro-vibration pulse for finely vibrating the ink meniscus on the nozzle surface and is applied to the piezoelectric element 421 in a case of dot absence. The driving pulse PS2 is a pulse for ink discharge for forming dots and is applied to the piezoelectric element 421 in a case of dot presence. The amplitude Vh of the driving pulse is shown in the driving pulse PS2, and the dot size can be finely adjusted by adjusting the amplitude Vh.

Figure 6:
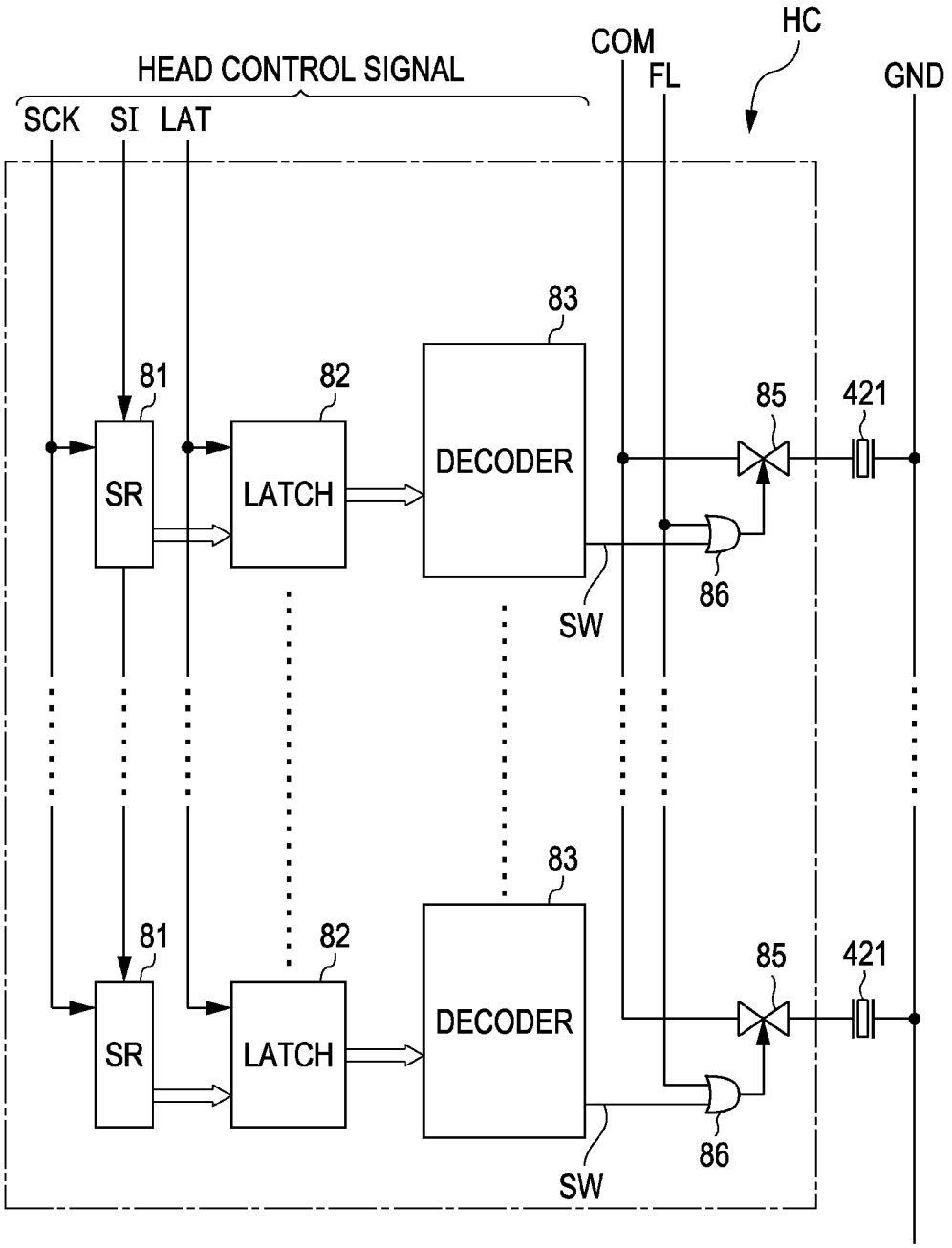
FIG. 6 is a diagram illustrating an example of a circuit that drives the ink discharge mechanism in the head unit.

FIG. 6 is a diagram illustrating an example of a circuit that drives the ink discharge mechanism in the head unit 150. Here, for convenience of description of the circuit, a head control circuit HC is described as the circuit.

The head control circuit HC includes a shift register (SR) 81, a latch circuit (latch) 82, a decoder 83, a control logic 84, a switch 84, and an OR circuit 86. The shift register 81, the latch circuit 82, the decoder 83, the switch 85, and the OR circuit 86 are provided in each of the piezoelectric elements 421.

The head control circuit HC performs control for discharging ink on the basis of pixel data SI from the controller 110. That is, the head control circuit HC selectively applies necessary portions of the driving signal COM to the piezoelectric element 421 by controlling the switch 85 on the basis of print data.

In this embodiment, the pixel data SI is sent to the head control circuit HC in synchronization with a clock SCK for transmission. The pixel data is included in the image data sent from the computer 1. The pixel data in this embodiment is data representing whether or not a dot is to be formed in each pixel in the recording medium S. The pixel data SI is configured of a single bit and is determined for each nozzle Nz (piezoelectric element 421). In addition, the pixel data SI corresponding to a pixel in which no dot is formed is set to "0", and the pixel data SI corresponding to a pixel in which a dot is formed is set to "1".

Each piece of the pixel data SI is set in the shift register 81. The latch circuit is connected to the shift register 81, and when a latch signal LAT from the controller 110 comes to be an H level, the pixel data SI corresponding to each of the latch circuits 82 is latched and input to the decoder 83.

The decoder 83 performs decoding on the basis of the pixel data SI and outputs a switch control signal SW for controlling the switch 85. The switch control signal SW output from the decoder 83 is input to the switch 85. The switch 85 is a switch that is turned on and off in response to the switch control signal SW and applies the driving signal COM to the piezoelectric element 421 in an ON period. The driving signal COM from the driving signal generation circuit 117 is applied to the input side of the switch 85, and the piezoelectric element 421 is connected to the output side of the switch 85.

When the switch control signal SW is at an L level, the switch is turned off. In addition, when the switch control signal SW is at an H level, the switch is turned on. The decoder 83 performs decoding on the basis of the pixel data SI and switches the level of the switch control signal SW between the L level and the H level at a corresponding timing.

When the pixel data SI is "0", the decoder 83 causes the switch control signal SW to come to be the H level in the section T1 of the driving signal COM and causes the switch control signal SW to come to be the L level in the section T2, thereby applying the driving pulse PS1 to the piezoelectric element 421. Here, ink is not discharged from the nozzles.

When the pixel data SI is "1", the decoder 83 causes the switch control signal SW to come to be the L level in the section T1 of the driving signal COM and causes the switch control signal SW to come to be the H level in the section T2, thereby applying the driving pulse PS2 to the piezoelectric element 421. Here, ink is discharged from the nozzles.

In this manner, ink is discharged on the basis of the image data and dots based on the image data can be formed. On the other hand, when flushing is performed, transmission of the pixel data SI in the image data from the controller 110 is temporarily stopped, and in the meantime, a flushing control line FL enters an ON state. Accordingly, all driving pulses in the driving signal COM are applied to the piezoelectric element 421 and thus ink droplets are continuously discharged. Consequently, dots which are not based on the image data can be formed. In addition, when ink is discharged on the basis of the image data, the flushing control line FL enters an OFF state, and the switch is turned on and off in response to the switch control signal SW.

Here, flushing is an operation of supplying ink with an appropriate viscosity in the vicinity of nozzles in order to discharge ink that is thickened in the vicinity of ink nozzles from the nozzles forcibly so as to be shed. By performing flushing, ink clogging or the like in the nozzle is prevented, and printing can be appropriately performed.

Next, the recording modes of the printer 10 which uses the liquid ejecting apparatus according to the embodiment of the invention configured as described above will be described.

When a signal related to the front printing mode is input from the input operation unit 120, the controller 110 performs control so that recording operations as shown in FIGS. 7A to 7E are performed by each unit. In addition, there may be cases where the front printing mode is called the "first mode".

FIGS. 7A to 7E are diagrams illustrating the recording operations based on the front printing mode (the first mode) and are schematic diagrams of the carriage 14 and the recording medium S viewed in the main scanning direction. In FIGS. 7A to 7E, the direction perpendicular to the paper plane is the main scanning direction (first direction), and the direction from the left to the right of the paper plane is the sub-scanning direction (second direction). In addition, the direction in which the carriage 14 is moved from the inside of the paper plane to the front side is defined as a forward direction, and the direction in which the carriage 14 is moved from the front side of the paper plane to the inside is defined as a return direction.

As the carriage 14 is moved in the forward direction or in the return direction, ink is selectively discharged from the nozzle rows 151 to 155 of the head unit 150 mounted in the carriage 14. Accordingly, a new dot group is formed on the recording medium S (or, on a dot group formed on the recording medium S in advance). By repeating this operation, a predetermined image is printed on the recording medium S.

Hereinafter, description will be provided on the basis of the concepts of dot groups including an "image dot group", a "background dot group", and a "flushing dot group".

The "image dot group" is formed by ejecting ink from a recording head (liquid ejecting head) on the basis of image data, and is recognized as characters or pictures when a printed matter is seen.

The "background dot group" is formed by ejecting ink from the recording head (liquid ejecting head) on the basis of background data which is a kind of image data, and is recognized as an entirely painted background when a printed matter is seen.

The "flushing dot group" is formed by ejecting ink from the recording head (liquid ejecting head) on the basis of a flushing control signal (and thus not on the basis of image data) and is not recognized when a printed matter is seen.

Figure 7A:
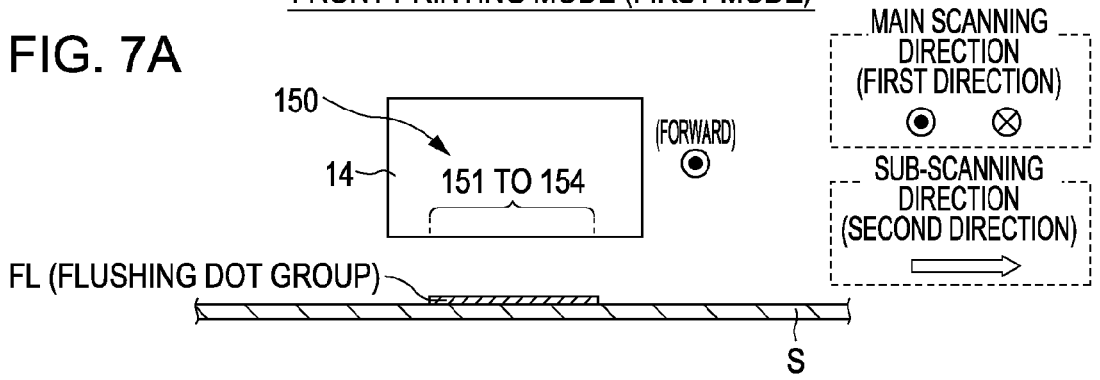
FIGS. 7A to 7E are diagrams illustrating recording operations in a front printing mode (first mode).

FIG. 7A shows a state where ejection from the nozzle rows 151 to 154 of the Y, M, C, and K ink for image recording, the ejection not being based on image data, is performed while moving the carriage 14 in the forward direction, and a flushing dot group is formed on the recording medium S (a process of forming flushing dots).

Although not shown in the figure, thereafter, the flushing dots are illuminated with UV light (first UV illumination process).

In the first UV illumination process, after the flushing dot group is formed, when a UV illumination light source is used, an application voltage that is lower than an application voltage applied to a UV illumination light source used in a second UV illumination process or a third UV illumination process described later is applied to illuminate the flushing dot group after the flushing dot group is formed.

Figure 7B:
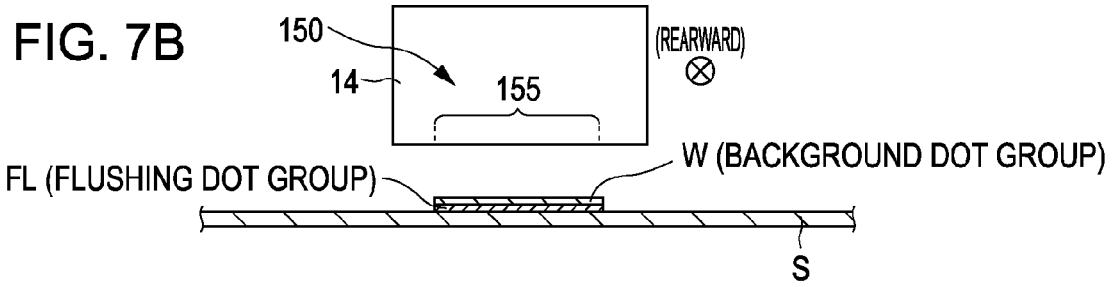

FIG. 7B shows a state where ejection from the nozzle row 155 of the W ink for entirely painting the background, the ejection being based on image data, is performed while moving the carriage 14 in the return direction and a background dot group is formed on the flushing dot group (a process of forming background dots). The background dot group constitutes the entire painting of the background of a predetermined image, and the range of the entire painting is determined on the basis of the image data received from the computer 1 which is a higher-level device or the like.

Although not shown in the figure, thereafter, the background dots are illuminated with UV light (second UV illumination process).

Figure 7C:
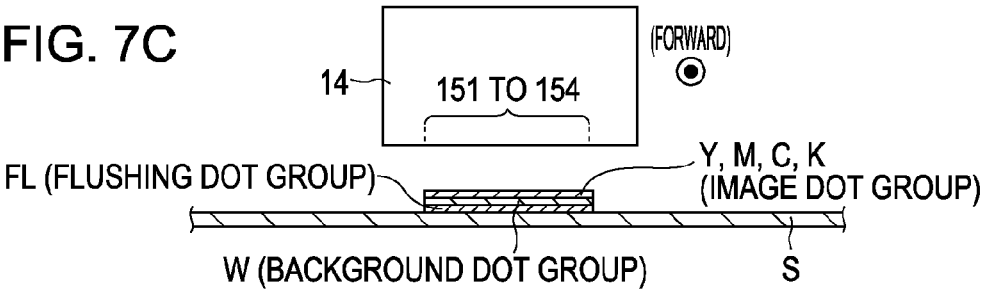

FIG. 7C shows a state where ejection from the nozzle rows 151 to 154 of the Y, M, C, and K ink for image recording, the ejection being based on the image data, is performed while moving the carriage 14 in the forward direction, and an image dot group is formed on the background dot group (a process of forming image dots).

Although not shown in the figure, thereafter, the image dots are illuminated with UV light (third UV illumination process).

Figure 7D:
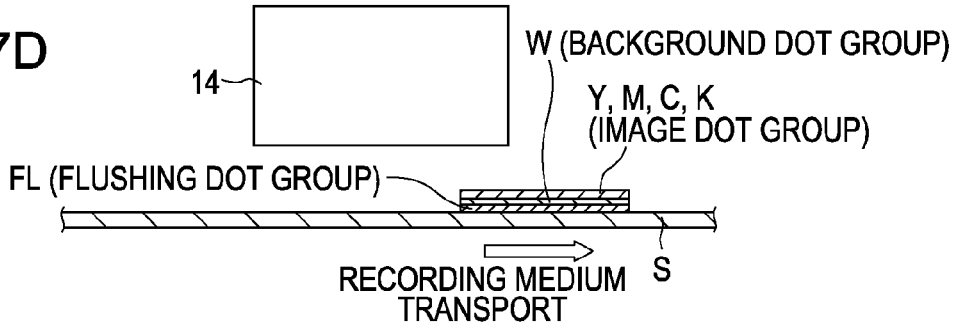

FIG. 7D shows a state where the recording medium S is transported by the carriage driving unit 140 by a distance corresponding to the length of the nozzle row.

Figure 7E:
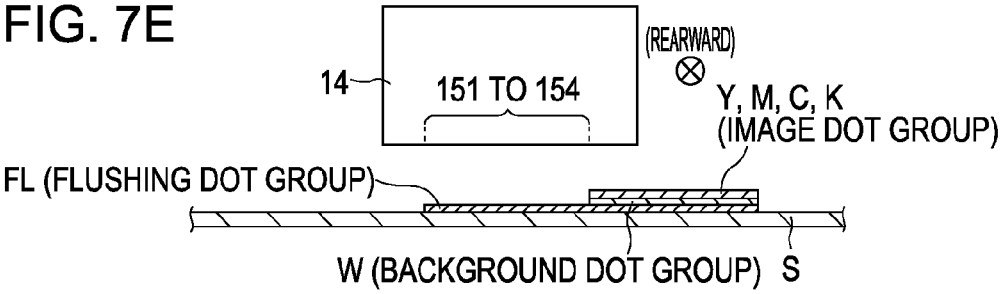

FIG. 7E shows a state where, similarly to FIG. 7A as above, ejection from the nozzle rows 151 to 154 which is not based on the image data is performed, and the flushing dot group is formed on the recording medium S. However, the movement direction of the carriage 14 in FIG. 7E is the return direction.

Hereinafter, although there is a difference in the movement direction of the carriage 14, each unit is controlled to sequentially laminate the flushing dot group, the background dot group, and the image dot group on the recording medium S, by repeating the same operations as those of FIGS. 7B to 7D.

Figure 8:
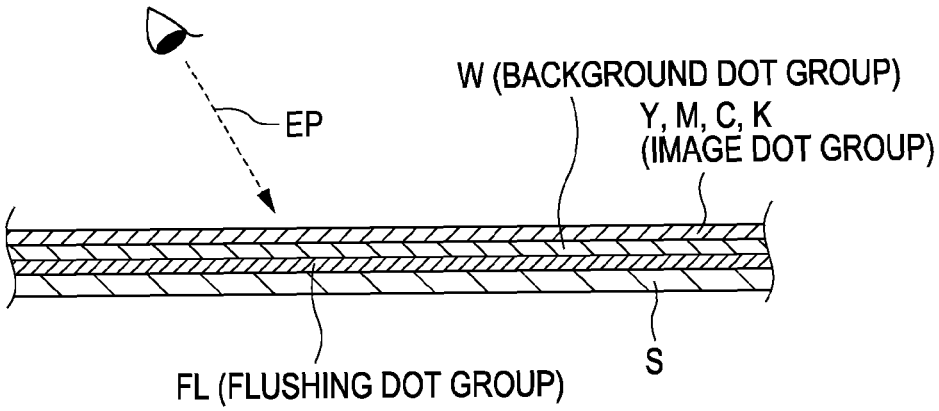
FIG. 8 is a diagram schematically showing a printed matter recorded in the front printing mode (first mode).

FIG. 8 is a diagram schematically showing a printed matter recorded in the front printing mode (first mode). As the matter printed in the front printing mode as shown in FIG. 8 is seen from a viewpoint (EP) from the recording surface side of the recording medium S, the flushing dot group is disposed at a position visually blocked by the background dot group. Therefore, without the need for a special configuration such as a liquid storage unit or a time to move the configuration, flushing is performed.

That is, according to the liquid ejecting apparatus and the control method of the liquid ejecting apparatus according to the embodiment of the invention, there is no need to provide a liquid storage unit such as a flushing box, such that a reduction in the size of the apparatus can be achieved without requiring a margin space in the apparatus housing of the printer. In addition, a time to perform an operation of moving the recording head and the liquid storage unit to approach each other becomes unnecessary, such that time loss during execution of printing can be suppressed, thereby enhancing throughput.

Next, the back printing mode of the printer 10 which uses the liquid ejecting apparatus according to the embodiment of the invention configured as described above will be described.

When a signal related to the back printing mode is input from the input operation unit 120, the controller 110 performs control so that recording operations as shown in FIGS. 9A to 9E are performed by each unit. In addition, there may be cases where the back printing mode is called the "second mode".

FIGS. 9A to 9E are diagrams illustrating the recording operations based on the back printing mode (the second mode) and are schematic diagrams of the carriage 14 and the recording medium S viewed in the main scanning direction. In FIGS. 9A to 9E, the direction perpendicular to the paper plane is the main scanning direction (first direction), and the direction from the left to the right of the paper plane is the sub-scanning direction (the second direction). In addition, the direction in which the carriage 14 is moved from the inside of the paper plane to the front side is defined as a forward direction, and the direction in which the carriage 14 is moved from the front side of the paper plane to the inside is defined as a return direction.

As the carriage 14 is moved in the forward direction or in the return direction, ink is selectively discharged from the nozzle rows 151 to 155 of the head unit 150 mounted in the carriage 14. Accordingly, a new dot group is formed on the recording medium S (or, on a dot group formed on the recording medium S in advance). By repeating this operation, a predetermined image is printed on the recording medium S.

Figure 9A:
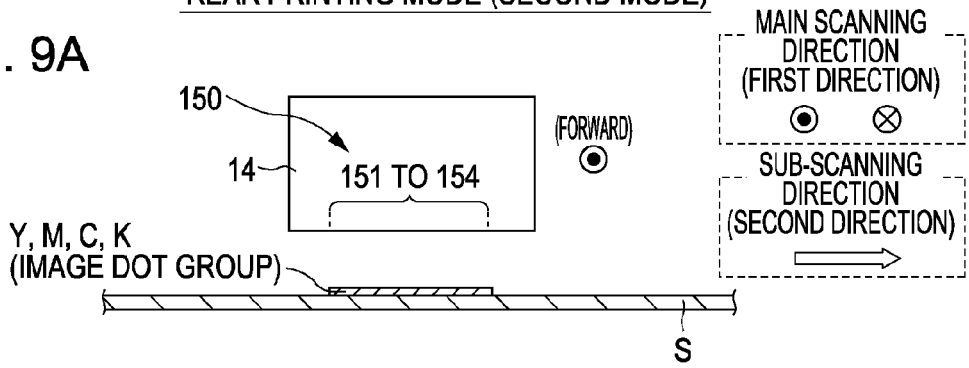
FIGS. 9A to 9E are diagrams illustrating recording operations in a back printing mode (second mode).

FIG. 9A shows a state where ejection from the nozzle rows 151 to 154 of the Y, M, C, and K ink for image recording, the ejection being based on image data, is performed while moving the carriage 14 in the forward direction, and an image dot group is formed on the recording medium S (a process of forming image dots).

Although not shown in the figure, thereafter, the image dots are illuminated with UV light (third UV illumination process).

Figure 9B:
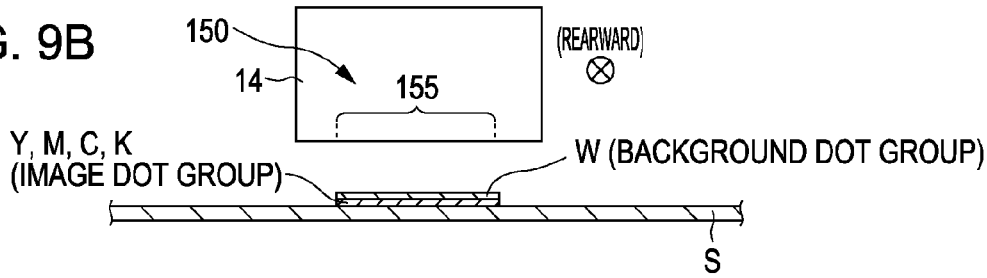

FIG. 9B shows a state where ejection from the nozzle row 155 of the W ink for entirely painting the background, the ejection being based on the image data, is performed while moving the carriage 14 in the return direction and a background dot group is formed on the image dot group (a process of forming background dots). The background dot group constitutes the entire painting of the background of a predetermined image, and the range of the entire painting is determined on the basis of the image data received from the computer 1 which is a higher-level device or the like.

Although not shown in the figure, thereafter, the background dots are illuminated with UV light (second UV illumination process).

Figure 9C:
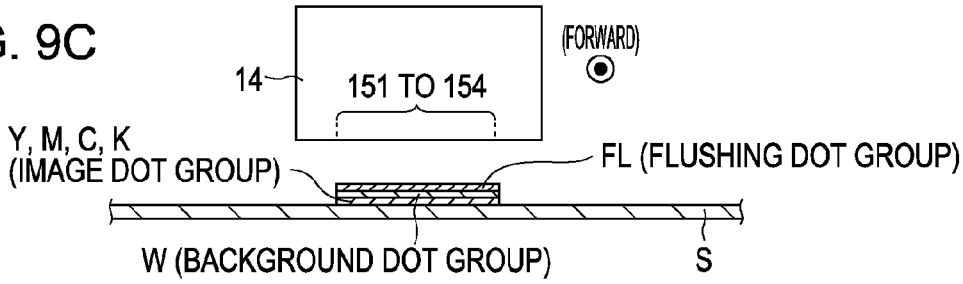

FIG. 9C shows a state where ejection from the nozzle rows of 151 to 154 the Y, M, C, and K ink for image recording, the ejection not being based on the image data, is performed while moving the carriage 14 in the forward direction, and a flushing dot group is formed on the background dot group (a process of forming flushing dots).

Although not shown in the figure, thereafter, the flushing dots are illuminated with UV light (first UV illumination process).

Figure 9D:
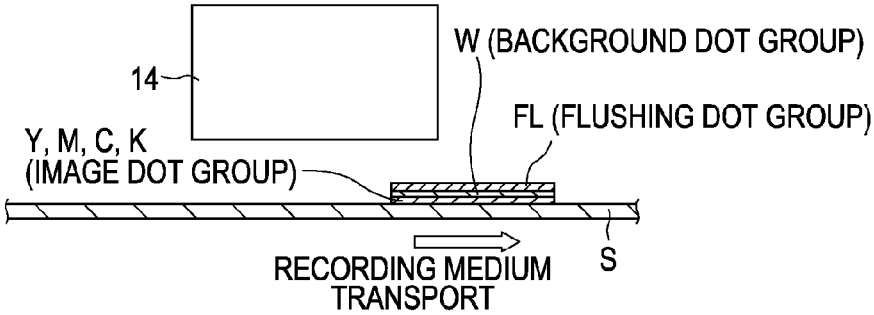

FIG. 9D shows a state where the recording medium S is transported by the carriage driving unit 140 by a distance corresponding to the length of the nozzle row.

Figure 9E:
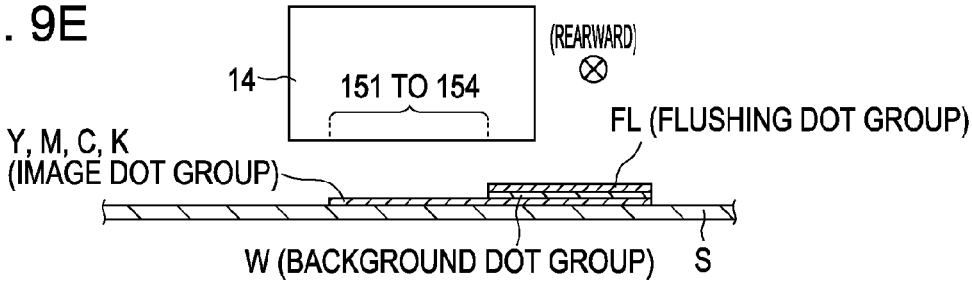

FIG. 9E shows a state where, similarly to FIG. 9A as above, ejection from the nozzle rows 151 to 154 which is not based on the image data is performed, and the image dot group is formed on the recording medium S. However, the movement direction of the carriage 14 in FIG. 9E is the return direction.

Hereinafter, although there is a difference in the movement direction of the carriage 14, each unit is controlled to sequentially laminate the image dot group, the background dot group, and the flushing dot group on the recording medium S, by repeating the same operations as those of FIGS. 9B to 9E.

Figure 10:
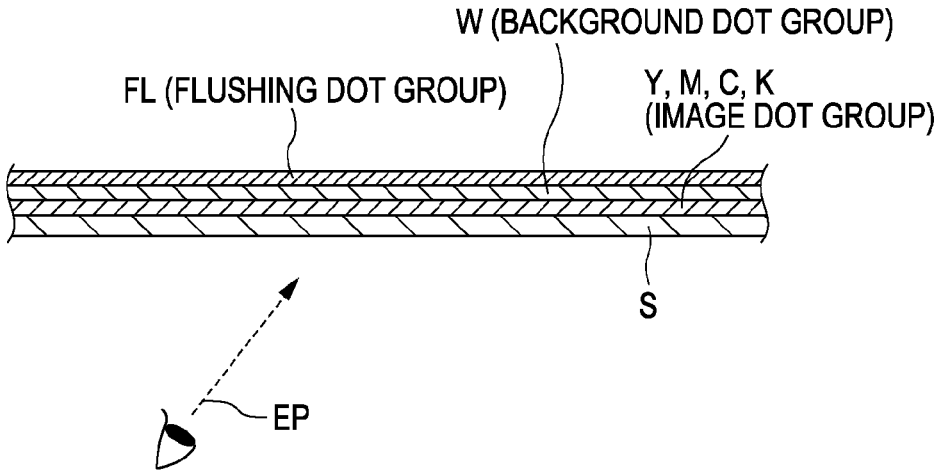
FIG. 10 is a diagram schematically showing a printed matter recorded in the back printing mode (second mode).

FIG. 10 is a diagram schematically showing a printed matter recorded in the back printing mode (second mode). As the matter printed in the back printing mode as shown in FIG. 10 is seen from a viewpoint (EP) from a side other than the recording surface side of the transparent or translucent recording medium S, the flushing dot group is disposed at a position visually blocked by the background dot group. Therefore, without the need for a special configuration such as a liquid storage unit or a time to move the configuration, flushing is performed.

That is, according to the liquid ejecting apparatus and the control method of the liquid ejecting apparatus according to the embodiment of the invention, there is no need to provide a liquid storage unit such as a flushing box, such that a reduction in the size of the apparatus can be achieved without requiring a margin space in the apparatus housing of the printer. In addition, a time to perform an operation of moving the recording head and the liquid storage unit to approach each other becomes unnecessary, such that time loss during execution of printing can be suppressed, thereby enhancing throughput.

As the recording modes of this embodiment, two recording modes including the front printing mode (first mode) and the back printing mode (second mode) are described. However, in the liquid ejecting apparatus and the control method of the liquid ejecting apparatus according to the embodiment of the invention, any of the front printing mode (first mode) and the back printing mode (second mode) can be selected by the input operation unit 120, and on the basis of this selection, the controller 110 is preferably configured to selectively perform any of the modes.

Next, another embodiment of the invention will be described. This embodiment is different from the above embodiment in that a nozzle row which ejects transparent (CL) ink, in addition to yellow (Y), magenta (M), cyan (C), black (K), and white (W) ink is added to the head unit 150. In addition, in the following description, the transparent (CL) ink is defined as a "third liquid". In addition, there may be cases where transparent ink is abbreviated to "CL" or the like.

By discharging the transparent (CL) ink as above onto the surface of the image recorded by the ink for image recording, a sense of smoothness, a sense of gloss, or a sense of high resolution of the printed matter can be enhanced.

Figure 11:
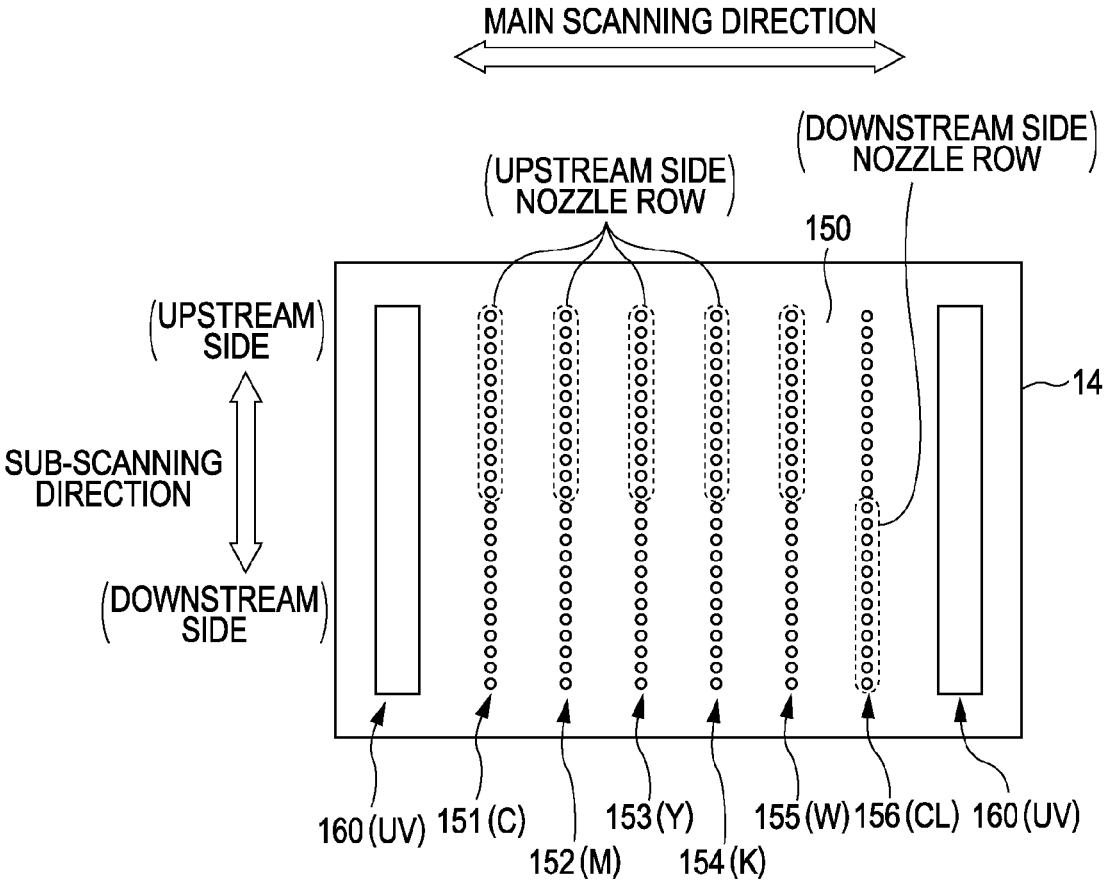
FIG. 11 is a diagram illustrating the head unit and the UV illumination unit mounted in the carriage of the liquid ejecting apparatus according to another embodiment.

FIG. 11 is a diagram illustrating the head unit 150 and the UV illumination unit 160 mounted in the carriage 14 of the liquid ejecting apparatus according to another embodiment. FIG. 11 schematically illustrates the bottom surface (a surface that opposes the recording medium S) of the carriage 14. In the head unit 150 according to this embodiment, in addition to the nozzle rows 151 to 155 provided in the above embodiment, a nozzle row 156 which discharges the transparent (CL) ink is provided.

In addition, the head unit 150 shown in FIG. 11 has a configuration in which all the nozzle rows 151 to 156 are provided in a single head structural member. However, a configuration in which the nozzles of each of the nozzle rows 151 to 155 are provided in a different head structural member and the head structural members are mounted in the carriage 14 may also be employed.

In addition, the recording operations of the front printing mode (first mode) and the back printing mode (second mode) without the use of the nozzle row 156 for discharging the transparent (CL) ink are the same as those of the above embodiment. This embodiment is characterized in that recording operations based on a front printing mode (hereinafter, also referred to as a "third mode") using the nozzle row 156 for discharging the transparent (CL) ink are performed.

Here, selection of an ink discharge area of the head unit 150 in the third mode will be described in detail with reference to FIG. 11.

When a signal related to the third mode is input from the input operation unit 120, as shown in FIG. 11, the controller 110 is set to perform recording operations using half the number of nozzles on the upstream side with regard to the nozzle rows of the nozzle rows 151 to 155 and half the number of nozzles on the downstream side with regard to the nozzle row of the nozzle row 156. Here, half the number of nozzle rows on the upstream side from the nozzle rows is defined as upstream side nozzle rows, and half the number of nozzle rows on the downstream side is defined as downstream side nozzle rows (see the nozzle rows surrounded by the dotted lines of FIG. 11).

Next, the recording modes of the printer 10 which uses the liquid ejecting apparatus according to another embodiment of the invention configured as described above will be described. When a signal related to the third mode is input from the input operation unit 120, the controller 110 performs control so that recording operations as shown in FIGS. 12A to 12E are performed by each unit.

FIGS. 12A to 12E are diagrams illustrating the recording operations based on the front printing mode (the third mode) and are schematic diagrams of the carriage 14 and the recording medium S viewed in the main scanning direction. In FIGS. 12A to 12E, the direction perpendicular to the paper plane is the main scanning direction (first direction), and the direction from the left to the right of the paper plane is the sub-scanning direction (second direction). In addition, the direction in which the carriage 14 is moved from the inside of the paper plane to the front side is defined as a forward direction, and the direction in which the carriage 14 is moved from the front side of the paper plane to the inside is defined as a return direction.

As the carriage 14 is moved in the forward direction or in the return direction, ink is selectively discharged from the nozzle rows 151 to 156 of the head unit 150 mounted in the carriage 14. Accordingly, a new dot group is formed on the recording medium S (or, on a dot group formed on the recording medium S in advance). By repeating this operation, a predetermined image is printed on the recording medium S.

Figure 12A:
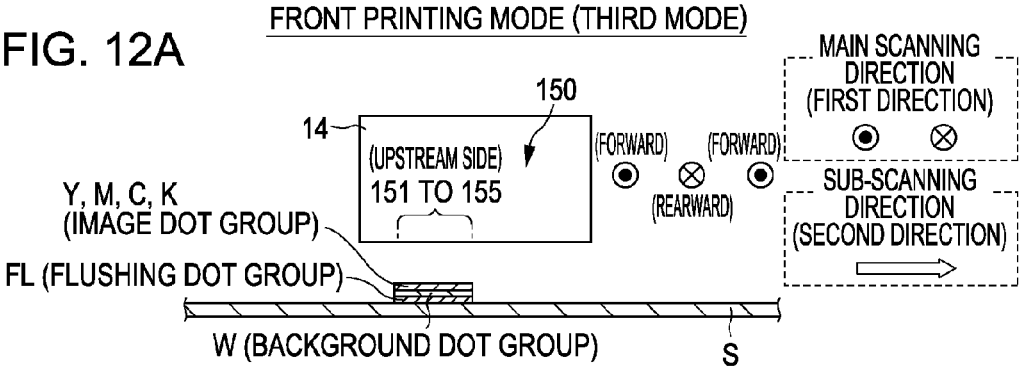
FIGS. 12A to 12E are diagrams illustrating recording operations in a front printing mode (third mode) according to another embodiment.

FIG. 12A shows a state where, while reciprocating the carriage 14, (1) a flushing dot group is formed on the recording medium S by performing ejection which is not based on image data from the upstream side nozzle rows 151 to 154 of the Y, M, C, and K ink for image recording, further, (2) a background dot group is formed on the flushing dot group by performing ejection which is based on image data from the upstream side nozzle row 155 of the W ink for entirely painting the background, and furthermore, (3) an image dot group is formed on the background dot group by performing ejection which is based on the image data, from the upstream side nozzle rows 151 to 154 of the Y, M, C, and K ink for image recording.

The series of the recording operations in FIG. 12A is the same as that of the front printing mode in the above embodiment except for the use of half the nozzle rows on the upstream side.

Figure 12B:
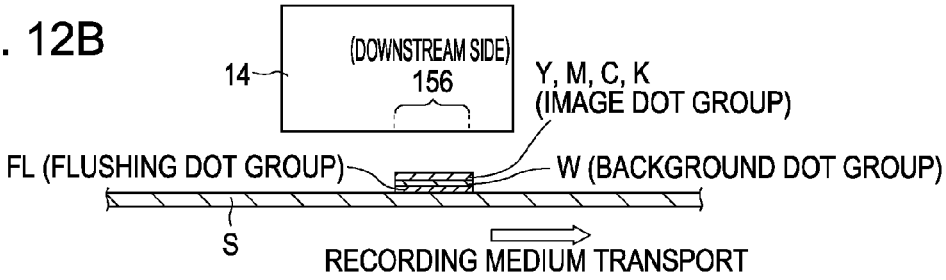

FIG. 12B shows a state where the recording medium S is transported by the carriage driving unit 140 by a distance corresponding to half the length of the nozzle row.

Figure 12C:
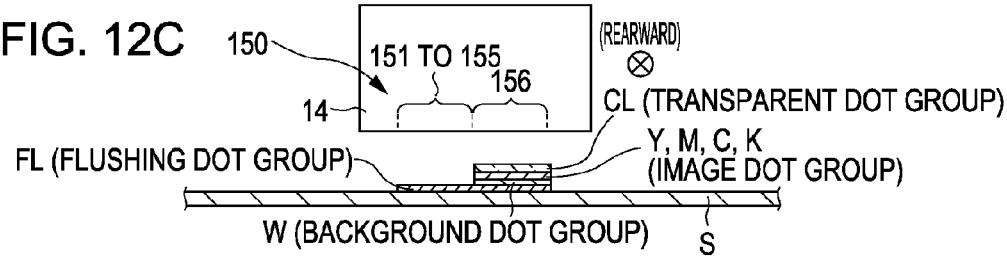

FIG. 12C shows a state where a flushing dot group is formed on the recording medium S by performing ejection which is not based on image data, from the upstream side nozzle rows 151 to 154 of the Y, M, C, and K ink for image recording while moving the carriage 14 in the return direction, and at the same time, a transparent dot group is formed on the image dot group formed in FIG. 12A by performing ejection based on the image data from the downstream side nozzle row 156 of the transparent ink.

Figure 12D:
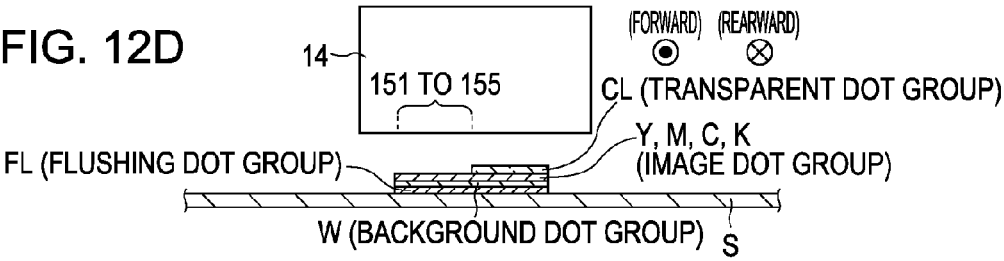

FIG. 12D shows a state where a background dot group is formed on the flushing dot group by performing ejection based on the image data from the upstream side nozzle row 155 of the W ink for entirely painting the background while reciprocating the carriage 14, and further, an image dot group is formed on the background dot group by performing ejection based on the image data from the upstream side nozzle rows 151 to 154 of the Y, M, C, and K ink for image recording.

Figure 12E:
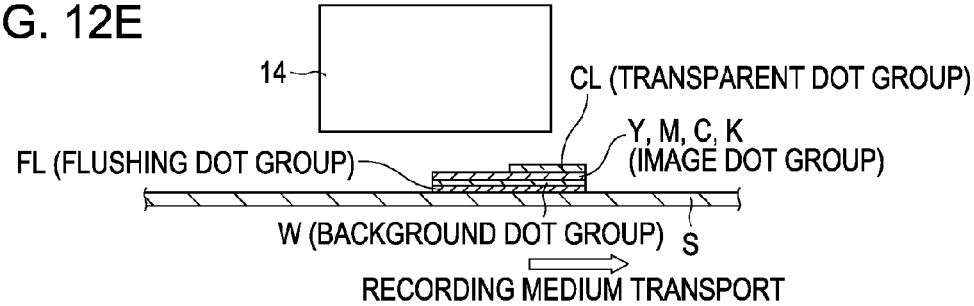

FIG. 12E shows a state where the recording medium S is transported by the carriage driving unit 140 by a distance corresponding to half the length of the nozzle row. Moreover, thereafter, although there is a difference in the movement direction of the carriage 14, each unit is controlled to sequentially laminate the flushing dot group, the background dot group, the image dot group, and the transparent dot group on the recording medium S by repeating the same operations as those of FIGS. 12C to 12E.

Figure 13:
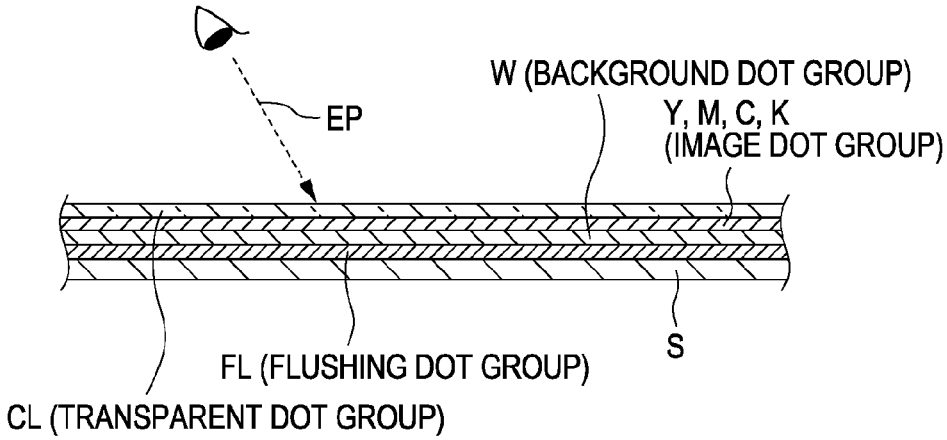
FIG. 13 is a diagram schematically showing a printed matter recorded in the front printing mode (third mode) according to another embodiment.

FIG. 13 is a diagram schematically showing a printed matter recorded in the front printing mode (third mode). As the matter printed in the front printing mode as shown in FIG. 13 is seen from a viewpoint (EP) from the recording surface side of the recording medium S, the flushing dot group is disposed at a position visually blocked by the background dot group. Therefore, without the need for a special configuration such as a liquid storage unit or time to move the configuration, flushing is performed.

That is, according to the liquid ejecting apparatus and the control method of the liquid ejecting apparatus according to the embodiment of the invention, there is no need to provide a liquid storage unit such as a flushing box, such that a reduction in the size of the apparatus can be achieved without requiring a margin space in the apparatus housing of the printer. In addition, a time to perform an operation of moving the recording head and the liquid storage unit to approach each other becomes unnecessary, such that time loss during execution of printing can be suppressed, thereby enhancing throughput.

In addition, in the printed matter recorded in the third mode, the transparent ink is disposed on the image, so that a sense of smoothness, a sense of gloss, or a sense of high resolution of the printed matter can be enhanced.

In addition, in the case of performing front printing in the third mode, the flushing dot group can be formed by discharging ink from the upstream side nozzle rows of the head unit 150, and at the same time, the transparent dot group can be formed by discharging the transparent ink from the downstream side nozzle rows of the head unit 150, thereby performing more efficient printing.

Figure 14:
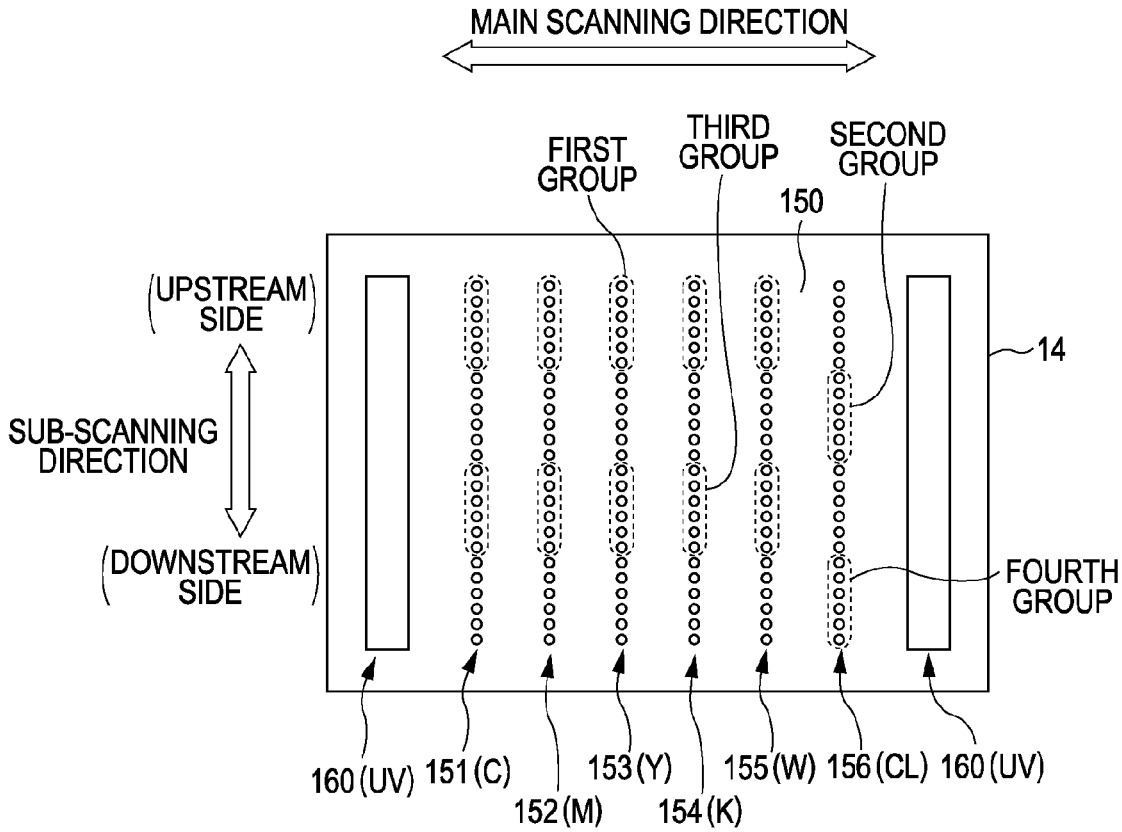
FIG. 14 is a diagram illustrating the head unit and the UV illumination unit mounted in the carriage in the liquid ejecting apparatus according to another embodiment.

Next, another embodiment of the invention will be described. In the embodiment related to FIG. 11, the nozzle rows of the nozzle rows 151 to 155 are set to be divided into half the number of nozzles on the upstream side and half the number of nozzles on the downstream side so as to perform the recording operations. However, in this embodiment, as shown in FIG. 14, the nozzle rows are set to be divided into 4 groups so as to perform recording operations.

In this embodiment, each nozzle row is divided by the equal number of nozzles from the upstream side to the downstream side into a nozzle row of a first group, a nozzle row of a second group, a nozzle row of a third group, and a nozzle row of a fourth group, and with regard to the nozzle rows 151 to 155 of the Y, M, C, K, and W ink, the nozzle rows of the first group and the nozzle rows of the third group perform the recording operations, and with regard to the nozzle row 156 of the CL ink, the nozzle rows of the second group and the nozzle rows of the fourth group perform the recording operations. Even in this embodiment, the same effects as those of the above embodiments can be achieved.

Next, another embodiment of the invention will be described. In the above embodiments, the printer 10 of a serial type or a lateral type has been exemplified. However, in the following embodiments, a printer of a line head type will be exemplified. That is, in the embodiments described above, the recording head of the liquid ejecting apparatus is moved. However, in this embodiment, the recording head of the liquid ejecting apparatus is fixed.

Figure 15:
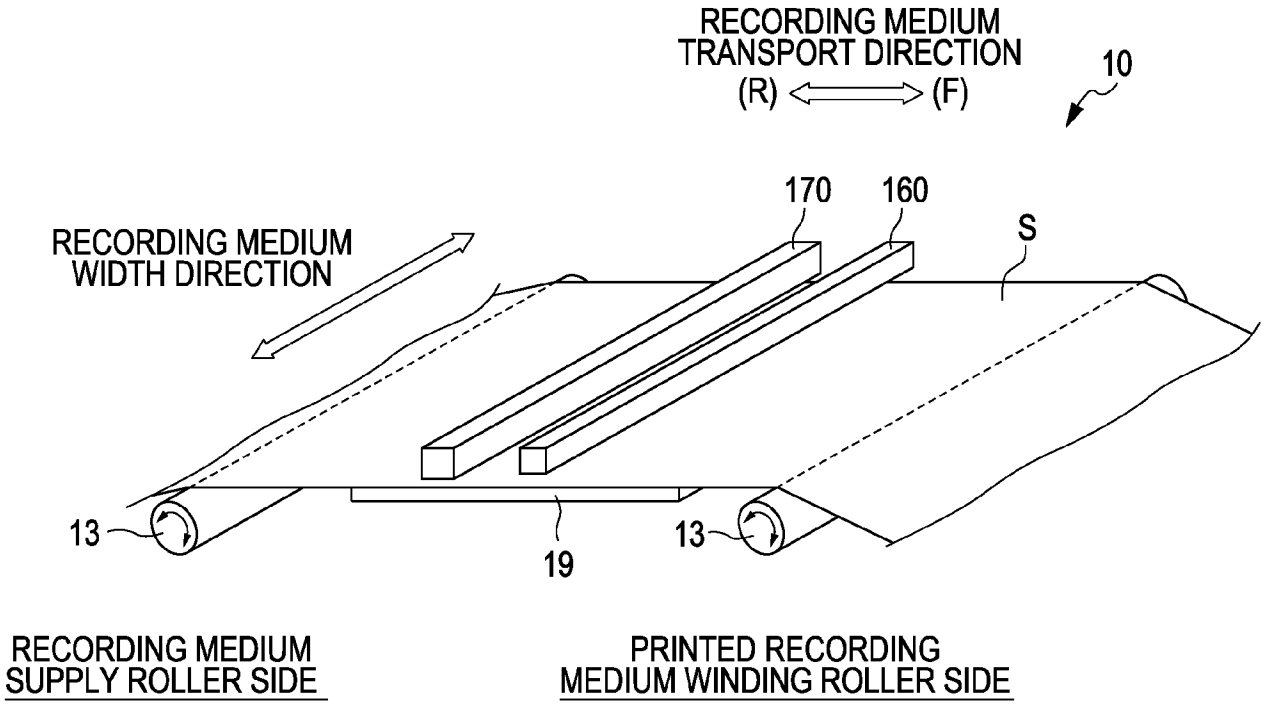
FIG. 15 is a diagram showing the overview of the printer which uses the liquid ejecting apparatus according to another embodiment of the invention.
Figure 16:
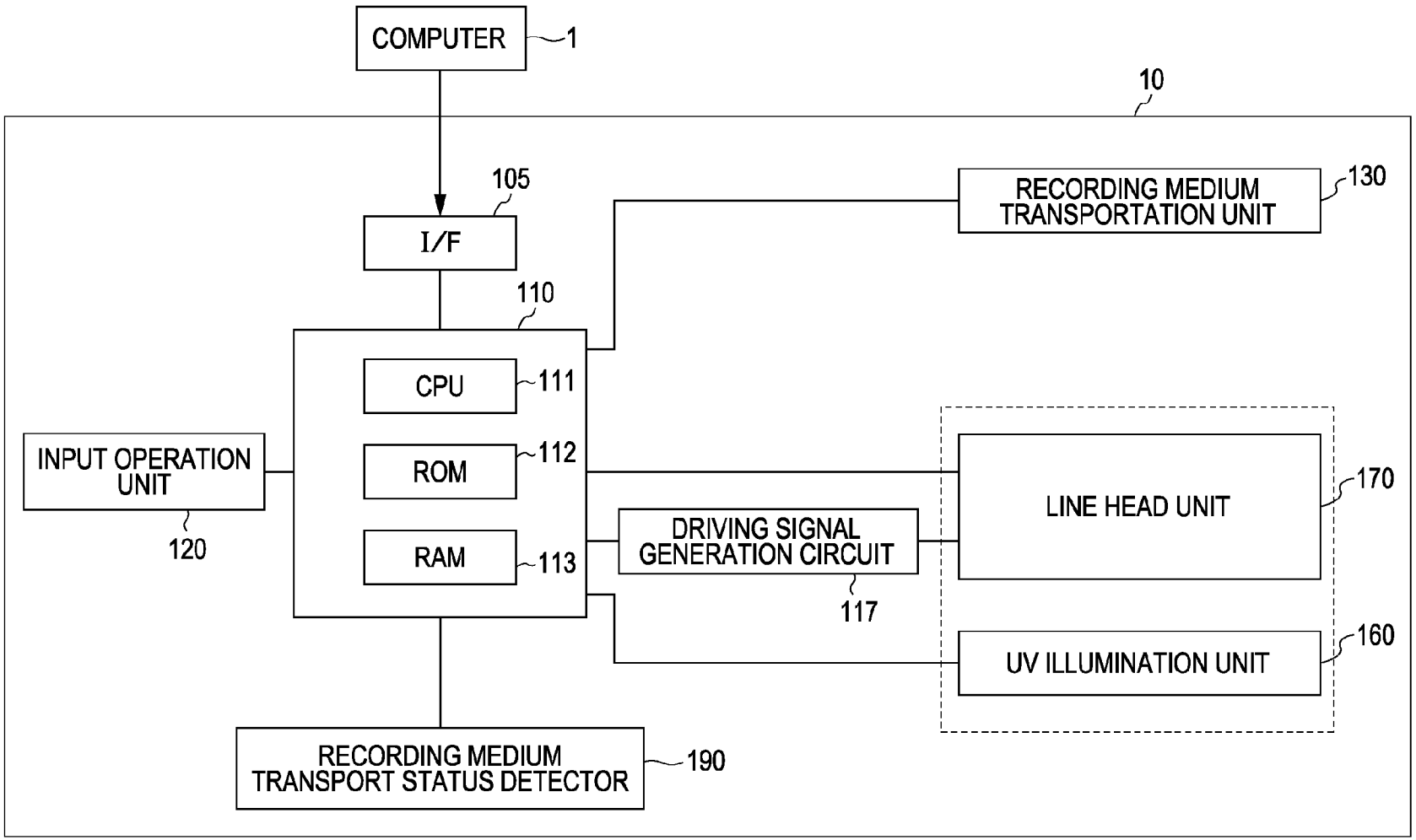
FIG. 16 is a block diagram of the entire configuration of the printer according to another embodiment.

FIG. 15 is a diagram showing the overview of the printer 10 which uses the liquid ejecting apparatus according to another embodiment of the invention, and FIG. 16 is a block diagram of the entire configuration of the printer 10 according to another embodiment. In addition, like elements of the same configuration as that of the embodiments described above are denoted by like reference numerals, and description thereof will be omitted.

In this embodiment, a line head unit 170 which is disposed to extend over the entire width of the recording medium S in the direction perpendicular to the transport direction of the recording medium S on the way of the transport path of the recording medium S without moving along the transport plane of the recording medium S is used. In addition, independently from the line head unit 170, a UV illumination unit 160 which illuminates ink with UV light is provided over the direction perpendicular to the transport direction of the recording medium S.

The line head unit 170 has a plurality of heads, and an image is formed on the recording medium S by discharging ink from each of the heads. The line head unit 170 is connected to the controller 110 and the driving signal generation circuit 117. In addition, the driving signal COM and the signal for controlling ink discharge described above are sent. From the line head unit 170 in this embodiment, UV ink (UV-curable ink) is discharged.

Figure 17:
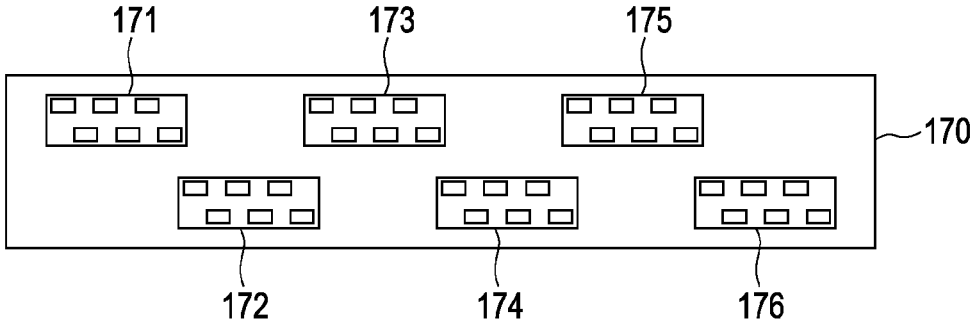
FIG. 17 is an explanatory view of a line head unit.

FIG. 17 is an explanatory view of the line head unit 170. The line head unit 170 includes 6 intermediate head units 171 to 176. Details of the intermediate head units 171 to 176 will be described later. However, the intermediate head units 171 to 176 are disposed so that the shortest nozzle pitch between the adjacent intermediate head units is equal to a nozzle pitch P in the head described later.

Figure 18:
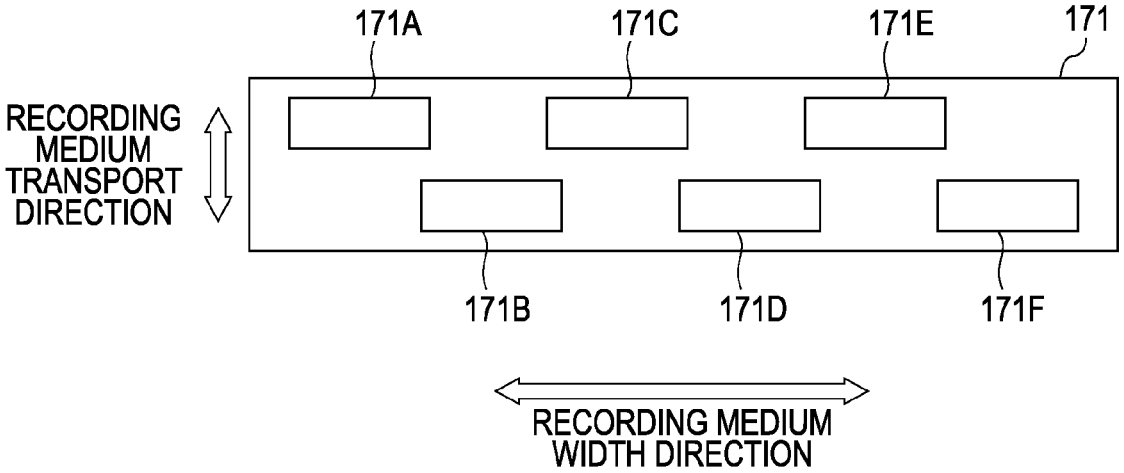
FIG. 18 is an explanatory view of an intermediate head unit.

FIG. 18 is an explanatory view of the intermediate head unit 171. The intermediate head unit 171 includes first to sixth heads 171A to 171F. FIG. 18 is a diagram of the intermediate head unit 171 viewed from above. Originally, each head in the intermediate head unit 171 is impeded by other elements and thus is not visible. However, here, for convenience of description, the first to sixth heads 171A to 171F are shown to be visible.

The heads are disposed so that the first to sixth heads 171A to 171F are lined up in the width direction of the recording medium S. Here, in the width direction of the recording medium S, in order to cause the intervals of the nozzles from the end portion of the first head 171A to the end portion of the sixth head 171F to be always uniform, odd-numbered heads and even-numbered heads are disposed to be misaligned in the transport direction of the recording medium S. In addition, the first to sixth heads 171A to 171F are disposed so that the shortest nozzle pitch between the adjacent heads to be equal to the nozzle pitch P described later.

Figure 19:
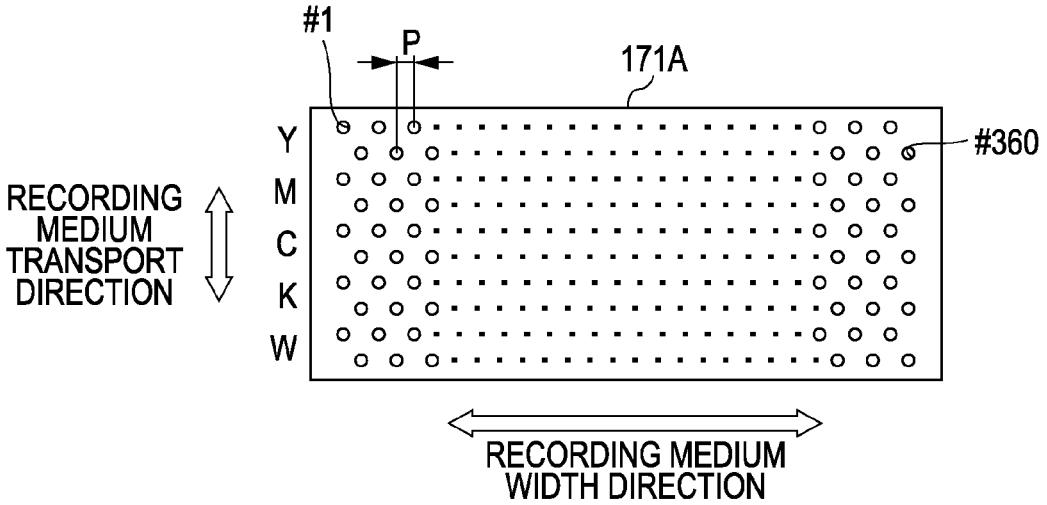
FIG. 19 is a diagram illustrating a nozzle arrangement of a first head.

FIG. 19 is a diagram illustrating a nozzle arrangement of the first head 171A. Here, FIG. 19 is a diagram of the first head 171A also viewed from above. Originally, the nozzles in the first head 171A are impeded by other elements from above and thus are not visible. However, here, for description, the nozzles are shown to be visible.

The first head 171A includes nozzle rows for each of yellow Y, magenta M, cyan C, black K, and white W. The first head 171A has two nozzle rows for each ink color. For each ink color of the first head 171A, from among the two nozzle rows, the nozzles of the one nozzle row are disposed between the nozzles of the other nozzle row, and the nozzle pitch P in the direction along the nozzle row (the width direction of the recording medium S) is realized. In this manner, in this embodiment, a nozzle pitch P of 360 dpi in the width direction of the recording medium is realized. In addition, the nozzle rows for yellow Y, magenta M, cyan C, and black K correspond to the nozzle rows of the first liquid ejecting nozzles that eject the first liquid for forming an image, and the nozzle rows for white W correspond to the nozzle rows of the second liquid ejecting nozzles that eject the second liquid.

The configurations of the second to sixth heads 171B to 171F are the same as that of the first head 171A. In addition, the first and second heads 171A and 171B are disposed so that the nozzle pitch P between the nozzle #360 of the first head 171A and the nozzle #1 of the second head 171B is the nozzle pitch P. The arrangement of each of the second to sixth heads 171B to 171F is the same as this arrangement, so that nozzle pitches of 360 dpi between the nozzles from the end portion of the first head 171A to the end portion of the sixth head 171F in the sheet width direction are realized.

Figure 21:
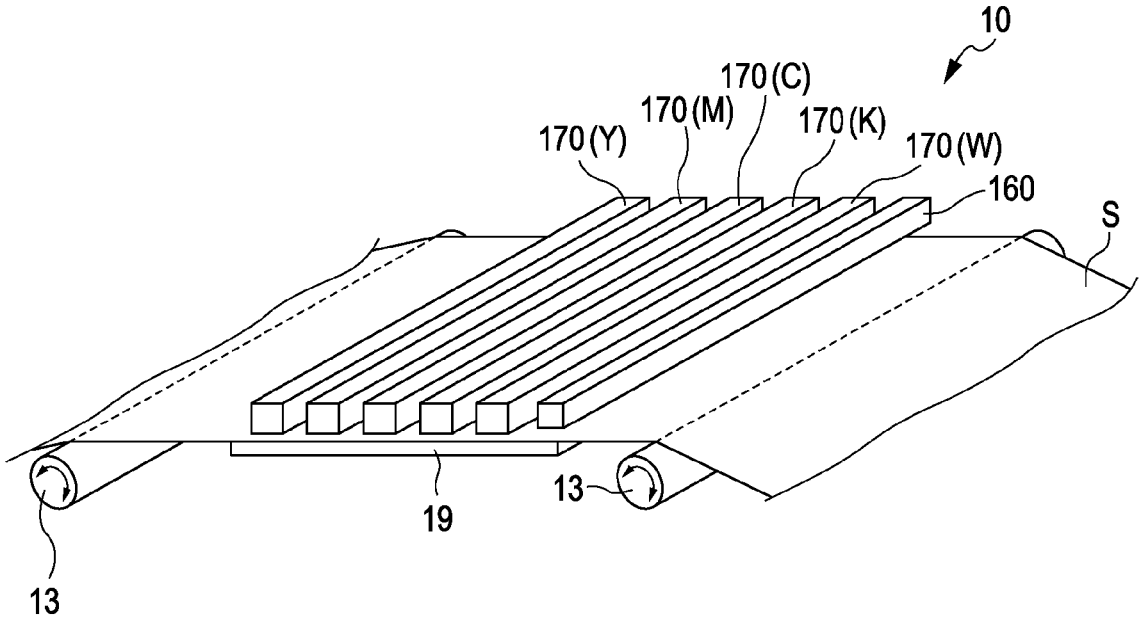
FIG. 21 is a diagram of an example in which the printer is configured by the line head units (liquid ejecting heads) each of which ejects ink with a single color.

In addition, the line head unit 170 (liquid ejecting head) used in this embodiment has a configuration in which a unit head including the nozzle rows for all the yellow Y, magenta M, cyan C, black K, and white W ink is used in a single head unit. However, a configuration may also be employed in which the line head unit 170 (liquid ejecting head) is constituted by a unit head provided with nozzle rows for only one color ink so as to be prepared for each color, and the line head units 170 (liquid ejecting head) for the colors are disposed to be lined up in the transport direction of the recording medium S. This is shown in FIG. 21 more specifically. FIG. 21 is a diagram of an example in which the printer 10 is configured by the line head units 170 (liquid ejecting heads) each of which ejects ink with a single color.

In the example of FIG. 21, each of the line head units 170 (liquid ejecting heads) is configured to eject ink of a single color. However, a plurality of line head units 170 (liquid ejecting heads) that eject ink of two or more colors may be combined to be included in the printer 10.

Even in this embodiment, as shown in FIG. 16, the recording medium transport unit 130 for sending the recording medium S is provided. The recording medium transport unit 130 intermittently transports the recording medium S in an (F) direction or an (R) direction in FIGS. 22A to 22E by repeating transport and stop of the recording medium S during image recording.

In addition, in order to detect the transport status of the recording medium S, a recording medium transport status detector 190 is provided, and detection data obtained by the recording medium transport status detector 190 is input to the controller 110 so as to be used to control the recording medium transport unit 130, the line head unit 170, and the UV illumination unit 160.

Figure 20:
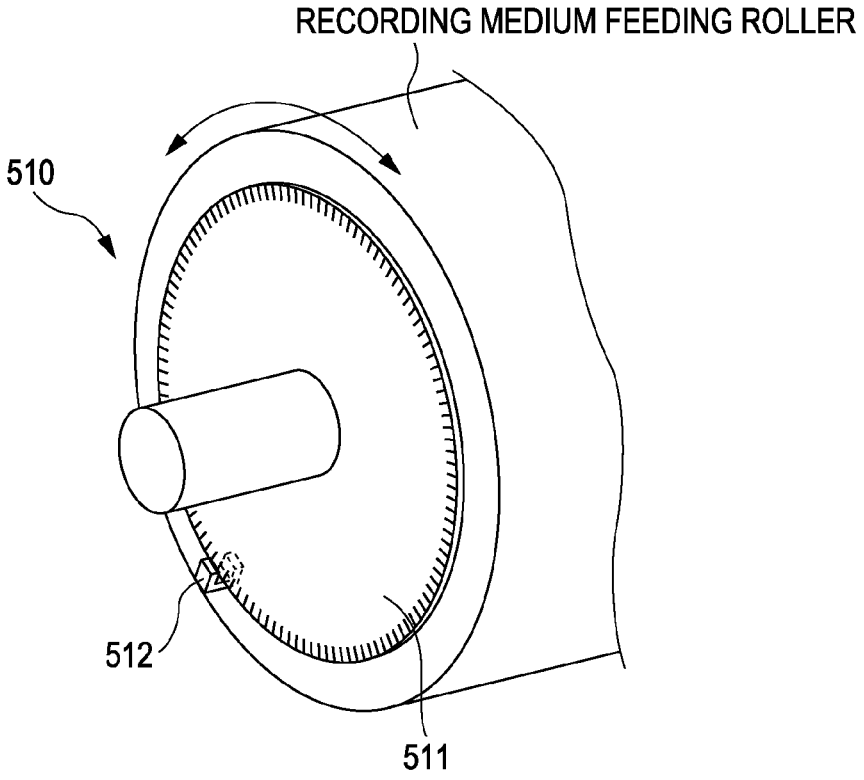
FIG. 20 is a diagram illustrating a rotary encoder.

As a specific configuration for realizing the recording medium transport status detector 190 used in this embodiment, a rotary encoder may be employed. FIG. 20 is a diagram illustrating a rotary encoder 510. The rotary encoder 510 includes a rotating disc 511 having a number of slits provided at predetermined intervals, and a detection unit 512. The rotating disc 511 is fixed to a rotation shaft 12 of a drum included in the recording medium transport unit 130 and thus is rotated by rotation of the drum. The detection unit 512 is fixed to the printer 10 side.

The rotary encoder 510 outputs a pulse signal ENC to the controller 110 whenever the slits provided in the rotating disc 511 pass the detection unit 512. The controller 110 can perceive the transport status of the recording medium S by perceiving a rotation angle and a rotation speed of the drum on the basis of the pulse signal ENC.

Next, the recording modes of the printer 10 which uses the liquid ejecting apparatus according to another embodiment of the invention configured as described above will be described.

When a signal related to the front printing mode is input from the input operation unit 120, the controller 110 performs control so that recording operations as shown in FIGS. 22A to 22E are performed by each unit. In addition, even in this other embodiment, there may be cases where the front printing mode is called the "first mode".

FIGS. 22A to 22E are diagrams illustrating the recording operations based on the front printing mode (the first mode) and are schematic diagrams of the line head unit 170 and the recording medium S viewed in the width direction of the recording medium S. In FIGS. 22A to 22E, the direction perpendicular to the paper plane is the width direction of the recording medium, and a horizontal direction on the paper plane is the transport direction of the recording medium. In addition, from the transport direction of the recording medium, the direction from the left to the right of the paper plane is defined as the (F) direction, and the direction from the right of the paper plane to the left is defined as the (R) direction.

Figure 22A:
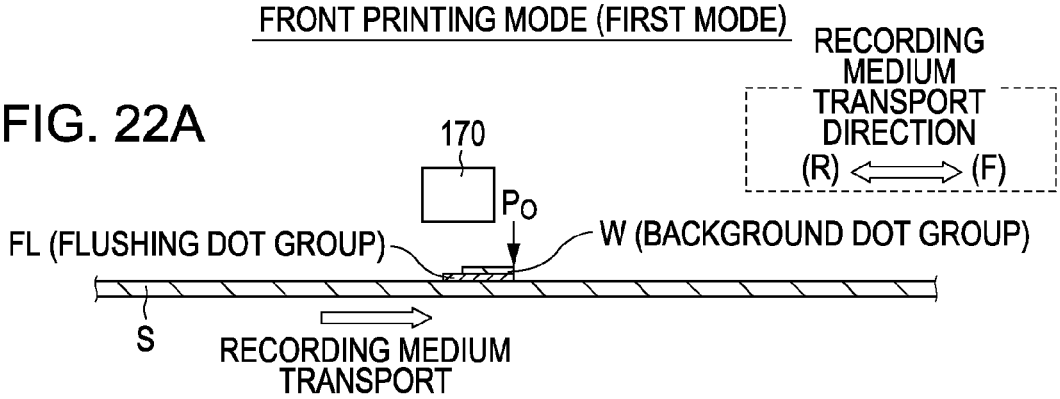
FIGS. 22A to 22E are diagrams illustrating recording operations in the front printing mode (first mode) in the liquid ejecting apparatus according to another embodiment.

FIG. 22A shows a state where ejection which is not based on image data from the nozzle rows of the Y, M, C, and K ink for image recording is performed while moving the recording medium S in the (F) direction, a flushing dot group is formed on the recording medium S, further, ejection based on image data from the nozzle rows of the W ink for entirely painting the background is performed, and a background dot group is formed on the flushing dot group. In addition, $P_O$ in the figure represents a front line of a predetermined recording batch.

Figure 22B:
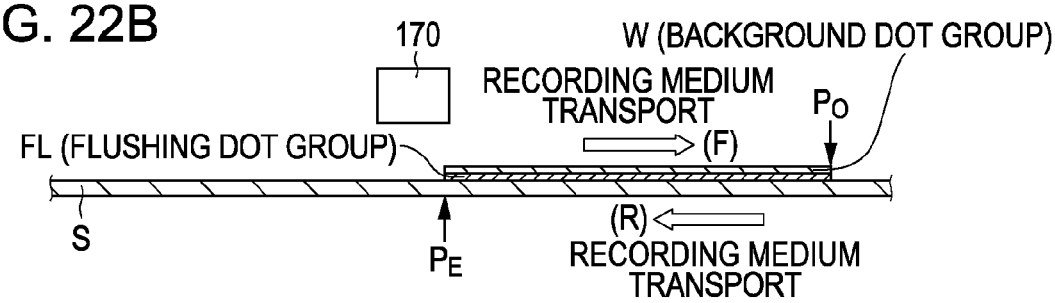

FIG. 22B shows that an operation (so-called switchback operation) of moving the recording medium S in the (R) direction after continuously performing the recording operation of FIG. 22A until a rear end line $P_E$ of the recording batch is performed.

Figure 22C:
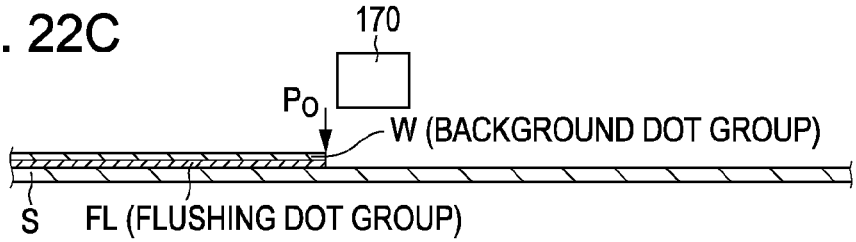

FIG. 22C shows a state where the recording medium S is continuously moved in the (R) direction to be set so that recording can be performed again by the line head unit 170 from the front line $P_O$ of the recording batch.

Figure 22D:
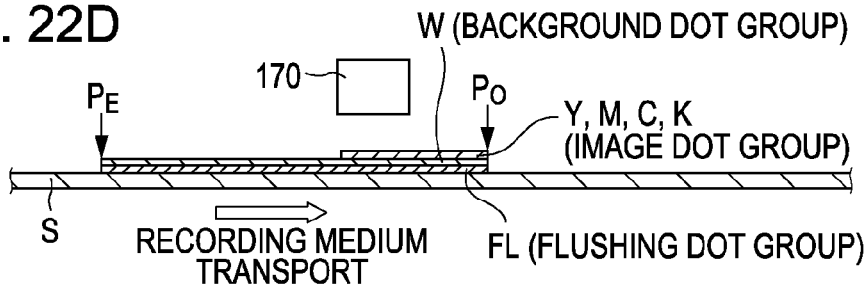

FIG. 22D shows a state where ejection based on the image data from the nozzle rows of the Y, M, C, and K ink for image recording is performed while moving the recording medium S in the (F) direction and an image dot group is formed on the background dots.

Figure 22E:
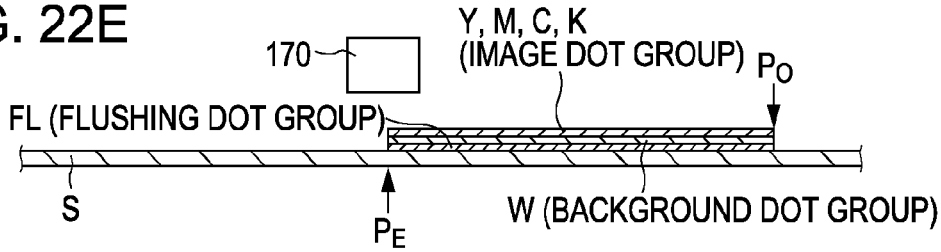

FIG. 22E shows that the recording operation of FIG. 22D is repeated until the rear end line $P_E$ of the recording batch. By repeating the same operations as those of FIGS. 22A to 22E, each unit is controlled to sequentially laminate the flushing dot group, the background dot group, and the image dot group on the recording medium S.

Even in this embodiment, the same effects as those of the above embodiments can be achieved.

Next, the back printing mode of the printer 10 which uses the liquid ejecting apparatus according to another embodiment of the invention configured as described above will be described.

When a signal related to the back printing mode is input from the input operation unit 120, the controller 110 performs control so that recording operations as shown in FIGS. 23A to 23E are performed by each unit. In addition, there may be cases where the back printing mode even in this other embodiment is called the "second mode".

FIGS. 23A to 23E are diagrams illustrating the recording operations based on the back printing mode (the second mode) and are schematic diagrams of the line head unit 170 and the recording medium S viewed in the width direction of the recording medium S. In FIGS. 23A to 23E, the direction perpendicular to the paper plane is the width direction of the recording medium, and a horizontal direction on the paper plane is the transport direction of the recording medium. In addition, from the transport direction of the recording medium, the direction from the left to the right of the paper plane is defined as the (F) direction, and the direction from the right of the paper plane to the left is defined as the (R) direction.

Figure 23A:
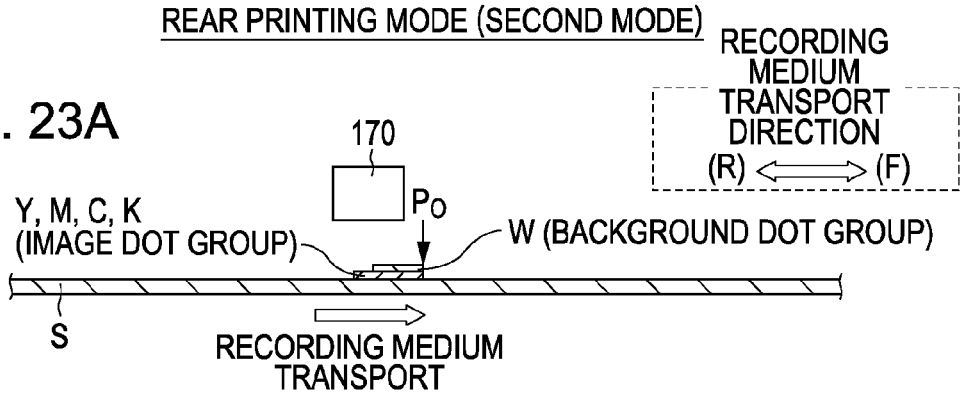
FIGS. 23A to 23E are diagrams illustrating recording operations in the back printing mode (second mode) in the liquid ejecting apparatus according to another embodiment.

FIG. 23A shows a state where ejection based on image data from the nozzle rows of the Y, M, C, and K ink for image recording is performed while moving the recording medium S in the (F) direction, an image dot group is formed on the recording medium S, further, ejection based on the image data from the nozzle rows of the W ink for entirely painting the background is performed, and a background dot group is formed on the image dot group. In addition, $P_O$ in the figure represents a front line of a predetermined recording batch.

Figure 23B:
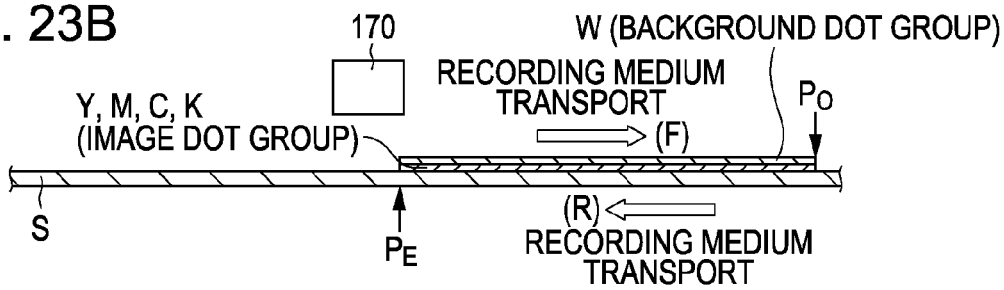

FIG. 23B shows that an operation (so-called switchback operation) of moving the recording medium S in the (R)

direction after continuously performing the recording operation of FIG. 23A until a rear end line $P_E$ of the recording batch is performed.

Figure 23C:
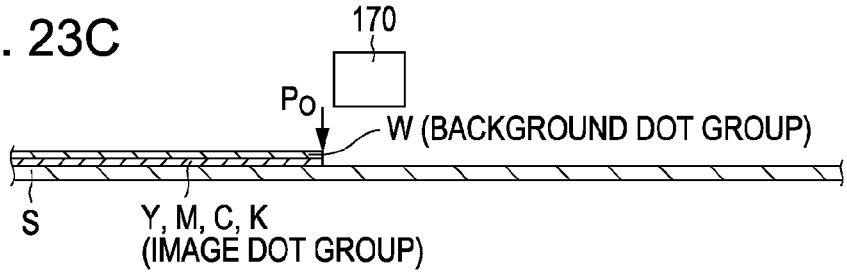

FIG. 23C shows a state where the recording medium S is continuously moved in the (R) direction to be set so that recording can be performed again by the line head unit 170 from the front line $P_O$ of the recording batch.

Figure 23D:
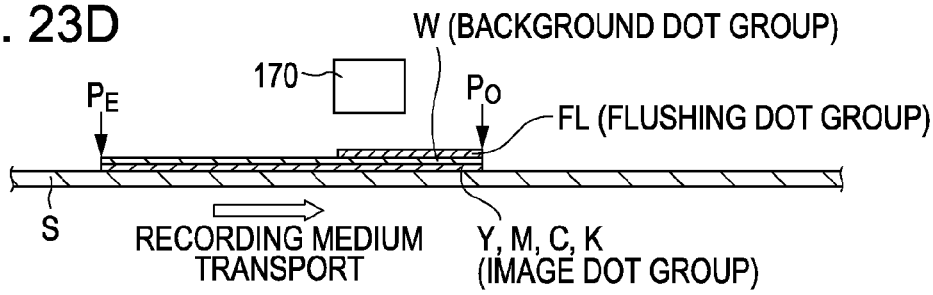

FIG. 23D shows a state where ejection which is not based on the image data from the nozzle rows of the Y, M, C, and K ink for image recording is performed while moving the recording medium S in the (F) direction and a flushing dot group is formed on the background dots.

Figure 23E:
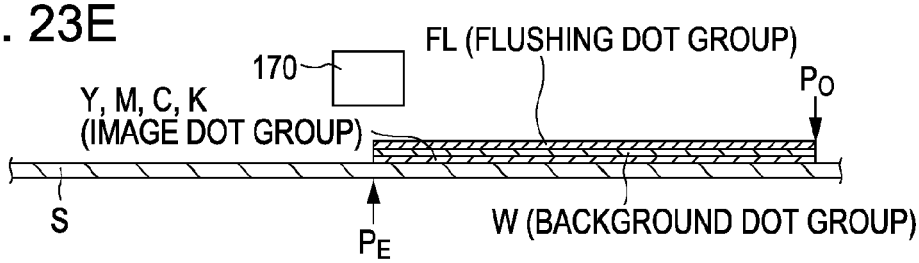

FIG. 23E shows that the recording operation of FIG. 23D is repeated until the rear end line $P_E$ of the recording batch. By repeating the same operations as those of FIGS. 23A to 23E, each unit is controlled to sequentially laminate the image dot group, the background dot group, and the flushing dot group on the recording medium S.

Even in this embodiment, the same effects as those of the above embodiments can be achieved.

Even in the other embodiment described above, any of the front printing mode (first mode) and the back printing mode (second mode) can be selected by the input operation unit 120, and on the basis of this selection, the controller 110 is preferably configured to selectively perform any of the modes.

In the liquid ejecting apparatus and the control method of the liquid ejecting apparatus according to the embodiments of the invention, each unit is controlled so that flushing dots are formed by ejection which is not based on image data and background dots are formed on the flushing dots by ejection based on image data, or background dots are formed by ejection based on image data and flushing dots are formed on the background dots by ejection which is not based on image data.

In the printed matter produced on the basis of the control method, the flushing dots are visually blocked by the background dots, so that the liquid ejecting apparatus can perform flushing without the need for a special configuration such as a liquid storage unit or time to move the configuration.

That is, according to the liquid ejecting apparatus and the control method of the liquid ejecting apparatus according to the embodiment of the invention, there is no need to provide a liquid storage unit such as a flushing box, such that a reduction in the size of the apparatus can be achieved without requiring a margin space in the apparatus housing of the printer. In addition, a time to perform an operation of moving the recording head and the liquid storage unit to approach each other becomes unnecessary, such that time loss during execution of printing can be suppressed, thereby enhancing throughput.

After the image dot group is caused to land on the recording medium S or another dot group by ejecting the ink from the nozzle rows of the head unit 150, the landing ink is immediately illuminated with UV light by the UV illumination unit 160 to cure the ink. In addition, similarly, the background dot group is caused to land on the recording medium S or another dot group by ejecting the ink from the nozzle rows of the head unit 150, the landing ink is immediately illuminated with UV light by the UV illumination unit 160 to cure the ink.

In addition, ejection of the background dot group may be performed after UV illumination after the flushing dot group is caused to land on the recording medium S or another dot group by ejecting the ink from the nozzle rows of the head unit 150. However, it is preferable that UV illumination with a different illumination configuration from that of UV illumination performed after forming the image dot group be performed.

For example, in the first mode, when UV illumination having the same condition as that of UV illumination performed after forming the image dot group or UV illumination performed after forming the background dot group is performed before the background dot group is formed after the flushing dot group is caused to land on the recording medium S or another dot group by ejecting ink, the flushing dot group scattering on the recording medium S is cured, and as a result, there may be a case where unevenness of the surface of the recording medium S becomes significant. In this case, the background dot group or the image dot group formed on the flushing dot group thereafter flows due to the unevenness formed on the recording medium S by the flushing dot group and may deviate from its landing position. In such a case, it is assumed that print quality of the printed matter is degraded and a printed matter having desired print quality cannot be produced.

Here, the inventors as a result of intensive study have come to understand the following. That is, in a case where the ink after the flushing dot group is caused to land on the recording medium S is subjected to UV illumination, if UV illumination is performed at sufficiently lower energy than that after the image dot group lands or the background dot group lands, degradation of the print quality described above is suppressed.

In addition, when UV illumination is not performed on the ink after the flushing dot group is caused to land on the recording medium S, there are the same suppression effects. When UV illumination is not performed after the flushing dot group is caused to land on the recording medium S, the landing ink is less likely to be cured, such that there is a tendency of the flushing dots to spread from landing points on the surface of the recording medium S.

Accordingly, for example, in the first mode, it is assumed that inclination due to the unevenness that causes position deviation of the ink landing on the flushing dot group is suppressed.

In the first mode, when the UV illumination light source is used after the flushing dot group is formed on the recording medium S by ejecting ink, an application voltage is applied which is lower than an application voltage applied to the above-described light source in the second UV illumination process performed after the background dot group lands on the flushing dot group or the third UV illumination process performed after the image dot group lands on the background dot group, so as to illuminate the flushing dot group after forming the flushing dot group. Even in this method, there is the effect of suppressing degradation of print quality of the printed matter described above.

Similarly, when the UV-LED light source is used after the flushing dot group is formed on the recording medium S by ejecting ink, an application current is applied which is lower than an application current applied to the UV-LED light source in the second UV illumination process performed after the background dot group lands on the flushing dot group or the third UV illumination process performed after the image dot group lands on the background dot group, so as to illuminate the flushing dot group after forming the flushing dot group. Even in this method, there is the effect of suppressing degradation of print quality of the printed matter described above.

Similarly, when the UV-LED light source is used after the flushing dot group is formed on the recording medium S by ejecting ink and the UV-LED light source includes a plurality of light-emitting sources, after the flushing dot group is formed, the flushing dot group may be illuminated using a smaller number of light sources than the number of light sources that are lit up in the second UV illumination process performed after the background dot group lands on the flushing dot group or the third UV illumination process performed after the image dot group lands on the background dot group. Even in this method, there is the effect of suppressing degradation of print quality of the printed matter described above.

What is claimed is:

1. A control method of a liquid ejecting apparatus which includes a first liquid ejecting nozzle which ejects UV-curable first liquid, a second liquid ejecting nozzle which ejects UV-curable second liquid which is different from the first liquid, a UV illumination light source which illuminates the first liquid and the second liquid, and a control unit which performs control of ejection of the first liquid from the first liquid ejecting nozzle, ejection of the second liquid from the second liquid ejecting nozzle, and UV illumination of the ejected first liquid and the second liquid, the control method causing the control unit to perform control so as to sequentially perform:

forming flushing dots using UV-curable ink by ejection from the first liquid ejecting nozzle on a recording medium, the ejection being not based on image data;

illuminating the flushing dots with UV light;

forming background dots using UV-curable ink by ejection from the second liquid ejecting nozzle on the flushing dots, the ejection being based on the image data;

illuminating the background dots with UV light;

forming image dots using UV-curable ink by ejection from the first liquid ejecting nozzle on the background dots, the ejection being based on the image data; and illuminating the image dots with UV light, wherein illumination energy of the UV light illuminating the flushing dots in the illuminating of the flushing dots is lower than illumination energy of the UV light illuminating the background dots in the illuminating of the background dots.

2. The control method according to claim 1, wherein, when the UV illumination light source is a metal-halide lamp, an application voltage of the illuminating of the flushing dots is lower than an application voltage of the illuminating of the background dots.

3. The control method according to claim 1, wherein, when the UV illumination light source is a UV-LED, an application current of the illuminating of the flushing dots is lower than an application current of the illuminating of the background dots.

4. The control method according to claim 1, wherein, when the UV illumination light source is a UV-LED having a plurality of light-emitting sources, the number of light sources which are lit up in the illuminating of the flushing dots is smaller than the number of light sources which are lit up in the illuminating of the background dots.

5. A liquid ejecting apparatus which can produce a printed matter according to the control method of a liquid ejecting apparatus according to claim 1.

6. A liquid ejecting apparatus which can produce a printed matter according to the control method of a liquid ejecting apparatus according to claim 2.

7. A liquid ejecting apparatus which can produce a printed matter according to the control method of a liquid ejecting apparatus according to claim 3.

8. A liquid ejecting apparatus which can produce a printed matter according to the control method of a liquid ejecting apparatus according to claim 4.

9. A printed matter which is produced according to the control method of a liquid ejecting apparatus according to claim 1.

10. A printed matter which is produced according to the control method of a liquid ejecting apparatus according to claim 2.

11. A printed matter which is produced according to the control method of a liquid ejecting apparatus according to claim 3.

12. A printed matter which is produced according to the control method of a liquid ejecting apparatus according to claim 4.

* * * * *

UNITED STATES PATENT AND TRADEMARK OFFICE

CERTIFICATE OF CORRECTION

PATENT NO. : 8,668,325 B2
APPLICATION NO. : 13/246760
DATED : March 11, 2014
INVENTOR(S) : Usuda et al.

It is certified that error appears in the above-identified patent and that said Letters Patent is hereby corrected as shown below:

Title Page, Left-hand column under item [*]
Remove Notice of terminal disclaimer, "This patent is subject to a terminal disclaimer"

Signed and Sealed this
Third Day of March, 2015

Michelle K. Lee

Michelle K. Lee
*Deputy Director of the United States Patent and Trademark Office*